US005152803A

United States Patent [19]

Hangey et al.

[11] Patent Number: 5,152,803

[45] Date of Patent: Oct. 6, 1992

[54] METHODS AND COMPOSITIONS TO ENHANCE STAIN RESISTANCE OF CARPET FIBERS WITH WATER-SOLUBLE THIOCYANATE

[75] Inventors: Dale A. Hangey, Midlothian; Paul W. Harris; Daniel J. Corcoran, Jr., both of Richmond; Michael P. Friedberger, Petersburg; Charles J. Cole, Chester; William A. Archie, Petersburg, all of Va.; Roger N. Spitz, New York, N.Y.

[73] Assignee: Allied-Signal Inc., Morris Township, Morris County, N.J.

[21] Appl. No.: 671,624

[22] Filed: Mar. 19, 1991

Related U.S. Application Data

[60] Continuation of Ser. No. 351,628, May 15, 1989, abandoned, which is a division of Ser. No. 101,652, Sep. 28, 1987, abandoned.

[51] Int. Cl.[5] ..... C09B 67/00

[52] U.S. Cl. ..... 8/618; 8/115.51; 8/115.54; 8/115.68; 8/557; 8/620; 8/629; 8/924; 8/929

[58] Field of Search ..... 8/618, 620, 629, 115.68

[56] References Cited

U.S. PATENT DOCUMENTS

| | | | |
|---|---|---|---|
| 3,387,913 | 6/1968 | Tigler et al. | 8/546 |
| 3,576,588 | 4/1971 | Wilson | 8/534 |
| 3,652,199 | 3/1972 | Leung | 8/629 |
| 4,414,277 | 11/1983 | Oxenrider | 252/8.9 |
| 4,592,940 | 6/1986 | Blyth et al. | 252/8.7 |
| 4,680,212 | 7/1987 | Blyth et al. | 428/97 |

OTHER PUBLICATIONS

CRC Handbook of Chemistry and Physics, 65th Edition, 1984–1985, pp. B-95, B-104, B-160.

*Primary Examiner*—A. Lionel Clingman

[57] ABSTRACT

This invention relates to improved methods and compositions to enhance stain resistance of carpet fiber. The improved methods relate to a continuous aftertreatment for dyed carpet fabric and to two-step processes, either batch-batch, batch-continuous or continuous-continuous. The improved compositions are used in the processes to enhance stain resistance of carpet or carpet fiber and to overcome various prior drawbacks, such as, yellowing, oxidation and durability to cleaning. The sulfonated aromatic condensates are used to enhance stain resistance, and can be combined with fluorocarbon compounds for soil resistance, thiocyanates, and/or salts having divalent cations, such as magnesium sulfate. Also various dispersing agents, buffering acids and sequestering agents are disclosed.

24 Claims, No Drawings

METHODS AND COMPOSITIONS TO ENHANCE STAIN RESISTANCE OF CARPET FIBERS WITH WATER-SOLUBLE THIOCYANATE

This application is a continuation of application Ser. No. 351,628, filed May 15, 1989, which is a divisional of Ser. No. 101,652, filed Sep. 28, 1987, both now abandoned.

BACKGROUND OF THE INVENTION

This invention is related to improved methods and compositions to enhance stain resistance of carpet fibers. Sulfonated aromatic condensates alone in a new process or in combination with other compounds are used to improve stain resistance. Related technology is disclosed in commonly assigned g applications Ser. No. 889,705 filed Jul. 28, 1986, on sulfonated benzotriazoles and Ser. No. 074,487 filed Jul. 23, 1987, on sulfonated aromatic formaldehyde condensates, such as diphenyl ether condensates.

The following terms are defined for use in this specification.

By sulfonated aromatic condensate (s.a.c.) is meant any condensate of an aromatic compound whether sulfonated prior to or after condensation, particularly sulfonated aromatic formaldehyde condensate (s.a.f.c.), effective to enhance stain resistance of fiber or carpet fabric.

By thiocyanate is meant any salt, organic or inorganic, containing a cation and the thiocyanate anion.

By fluorocarbon is meant those fluorocarbon compounds effective to improve the antisoiling properties of fiber or carpet fabric.

By ICP is meant index of crystalline perfection, a measured indication of the internal crystal structure of the polymer in an oriented fiber. High ICP indicates an open crystalline internal structure, easily dyeable polymer fiber.

By nylon is meant the polyamide family of polymers, nylon 6, nylon 6,6, nylon 4, nylon 12 and the other polymers containing the

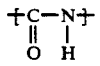

structure along with the $\text{+}CH_2\text{+}_x$ chain.

By carpet fabric is meant carpet fiber or yarn which has been typically tufted, woven, or otherwise constructed into fabric suitable for final use in home furnishings, particularly as floor covering.

By fiber is meant continuous filament of a running or extremely long length or cut or otherwise short fiber known as staple. Carpet yarn may be made of multiple continuous filaments or spun staple fiber, both typically pretextured for increased bulk.

By salt having a divalent; cation is meant any such salt effective to enhance stain resistance of fiber, particularly high ICP nylon fiber, when combined with an effective amount of a s.a.c.

By dispersing agent is meant any chemical compound or combination of chemical compounds effective to make stable, relatively nonprecipitating, noncoagulating mixtures of other chemical compounds.

By sequestering agent is meant any chelating agent which is effective in sequestration, which is the suppression of certain properties of a metal without removing it from the system or phase. To be practical, the sequestering agent must not cause any undesirable change that would render the system unsuitable for its intended purpose. Chelation produces sequestration mainly by reducing the concentration of free metal ion to a very low value by converting most of the metal to a soluble chelate that does not possess the properties to be suppressed.

A chelating agent is a compound containing donor atoms that can combine by coordinate bonding with a single metal atom to form a cyclic structure called a chelation complex or, simply, a chelate. Because the donor atoms are connected intramolecularly by chains of other atoms, a chelate ring is formed for each donor atom after the first which coordinates with the metal. The above is from Volume 5, beginning page 339, of the Kirk-Othmer Encyclopedia of Chemical Technology (John Wiley & Sons), 1979, hereby incorporated by reference to p. 367.

It is known to use sulfonated aromatic formaldehyde condensates ("s.a.f.c."s) in the yarn finish (during or after fiber quenching) to improve stain resistance of carpet fiber, see U.S. Pat. No. 4,680,212, in the dye bath for the same purpose, see U.S. Pat. No. 4,501,591 or incorporated into the fiber for the same purpose, see U.S. Pat. No. 4,579,762. All three above U.S. patents are hereby incorporated by reference, in toto. Use of fluorochemical to improve both stain and soil resistance in combination with s.a.f.c.'s is also taught in U.S. Pat. No. 4,680,212, column 5. Other useful fluorochemicals for antisoiling are taught in commonly assigned U.S. Pat. Nos. 4,192,754; 4,209,610; 4,414,277; 4,604,316; 4,605,587 all also hereby incorporated by reference, in toto.

It is known to use thiocyanates, such as ammonium thiocyanate, at different process conditions as "assists" during dyeing for various purposes. See U.S. Pat. Nos. 3,652,199; 3,576,588; 3,387,913; 2,899,262; and 2,615,718 all hereby incorporated by reference, in toto.

Use of salts containing a divalent cation, such as magnesium sulfate, with s.a.f.c.'s to improve wet fastness is known in U.S. Pat. No. 3,790,344, hereby incorporated by reference, in toto. Also see page 48 of a textbook by Rosen, M. J., *Surfactants & Interficial Phenomena* (Wiley, 1978).

It is also known generally to use acid, including citric acid to buffer a dye bath and to use dispersing agents and/or sequestering agents to stabilize a aqueous formulations of chemicals.

Nylon carpets may be permanently discolored or stained by certain artificial colorants, such as food dyes, or oxidizing agents, such as acne preparations containing benzoyl peroxide. S.A.C.'s, applied to the fiber to provide an ionic barrier to food colorants, make the fiber more stain resistant, but are not effective against oxidizing agents. Furthermore, many of the s.a.c.'s used commercially for the preparation of "stain resistant" carpets are themselves, susceptible to oxidation upon exposure to light and ozone. This results in a yellowing of the s.a.c. and subsequent destruction. This has a major impact on the carpet properties. The yellow color of the s.a.c. results in a perceptible shift in the color of the carpet. Construction of the s.a.c. results in a loss of the stain resistance properties of the carpet.

Use of fluorocarbon compound treated nylon fiber in carpet fabric inhibits wetting of the fiber surfaces which also inhibits any staining agent from being adsorbed onto or absorbed into the fiber. This surface wetting inhibition can be insufficient when the staining agent is dropped on the carpet with enough force to break the surface energy of the fluorocarbon surface barrier or not cleaned from the carpet and left in contact with fibers for extended time. Carpet treated with compositions containing s.a.c.'s must not interfere with the antisoiling properties of the fluorocarbon.

Application of s.a.c. to the carpet fabric must be effective, economical, and compatible to both untreated and fluorocarbon treated fiber, and to both continuous dyeing and Beck or batch dyeing. The same is true of any s.a.c. application formulation. The s.a.c. formulation must achieve effective penetration into the carpet fabric. Exhaustion of the individual active chemical components of any s.a.c. formulation must also be effective if not complete.

Certain nylon polymer fibers have very open internal crystal structure, namely high ICP polymer fiber, which require large amounts of s.a.c. to impart an effective degree of stain resistance. High ICP polymers are usually the result of high temperature saturated steam heat setting processes.

Some prior compositions and methods are only marginally acceptable regarding durability of the stain resistance when the carpet is steam cleaned with a detergent at a high pH.

SUMMARY OF THE INVENTION

This invention is several interrelated embodiments wherein the several new s.a.c. application formulations are used in the several new application processes. First described is a continuous aftertreatment for dyed nylon carpet fabric, using several combinations of chemical compositions to apply a s.a.c.. Then the two-step process of treating carpet fabric with a s.a.c., still using the continuous aftertreatment as the second step is described. This includes batch (or beck)-continuous and continuous-continuous two-step treatment. The combination of s.a.c. and the thiocyanates, and with various added chemicals, to improve resistance of dye and s.a.c. on the fiber to oxidation is next described. Then the method to improve stain resistance of nylon fiber, particularly high ICP fiber, using s.a.c., thiocyanate and a salt having a divalent cation and with additional added chemicals is described. The method to improve light induced yellowing of s.a.c. treated fiber by buffering with citric acid or any acid with a sequestering agent is an embodiment described throughout and specifically at this point. Then the new two-step batch-batch process is described used with various formulations. Finally described is an improved method to exhaust thiocyanate at low pH.

The first embodiment of this invention is a method to continuously treat dyed nylon carpet fabric to impart improved resistance to staining comprising preheating the dyed carpet fabric with water at a temperature of between about 140° and 212° F. (60° and 100° C.) to a wet pick-up of above about 75% by weight, and a carpet temperature of between about 130° and 210° F. (54.4° and 99° C.), then extracting the water from the carpet fabric to a wet pick-up of between about 30 to 190% by weight, then applying an aqueous solution of an effective amount of a sulfonated aromatic condensate to the carpet fabric at a pH of between about 1.5 to 5.5, at a concentration of between about 0.25 and 40 grams of solids of said condensate per liter of aqueous solution, at a wet pick-up between 200 and 650% by weight, an aqueous solution liquor of between about 140° and 212° F. (60° and 100° C.) to achieve a carpet fabric temperature between about 130° and 210° F. (54.4° and 99° C.), then holding the carpet in the aqueous solution for between about 0.5 to 90 seconds at a temperature above 130° F. (54.4° C.). The carpet fabric can subsequently be washed in water. The preferred sulfonated aromatic condensate has been condensed with formaldehyde. The method of extracting can be by applying vacuum to the wet carpet fabric or by squeezing the wet carpet fabric with a pair of rollers. The preferred concentration of the condensate is between about 0.25 and 10 grams per liter of aqueous solution. The preferred wet pick-up of the aqueous solution is between about 300 and 600% by weight. When the aqueous solution is applied by pressurized contact with the carpet fabric, the wet pick-up preferred maximum is 450%. When the aqueous solution is applied by spray, the preferred wet pick-up mimimum is 400%. It is preferred that the carpet fabric be held in the aqueous solution for between about 2 and 30 seconds. The preferred wet pick-up after extracting is between about 50 and 150% by weight. The sulfonated aromatic formaldehyde condensate can be formed by condensation of formaldehyde with one or more phenols. At least one of the phenols can be phenol sulfonic acid or the alkali metal salt thereof. It is preferred that one of the phenols be dihydroxy aromatic diphenylsulfone. It is most preferred that the condensate be formaldehyde condensed with the alkali metal salt of para-phenol sulfonic acid and with 4,4'-diphenylsulfone. The beginning dyed carpet fabric of this process may also comprise an effective amount of a fluorocarbon compound intended to improve resistance to soiling of the carpet. The preferred amount of fluorocarbon present is an amount of from about 0.05 to 0.4% by weight of the fabric. The fluorocarbon can contain perfluoroalkyl radical or can be a mixture of fluorinated pyromellitate oligomers. A more preferred fluorocarbon is a mixture of pyromellitate oligomers formed by two reactions, first, the reaction of pyromellitic dianhydride with the fluorinated alcohol, and second, the reaction product of the first reaction further reacted with epichlorohydrin. Another preferred fluorocarbon is a reaction product of a perfluoroalkyl alcohol or amide with a suitable anhydride or isocyanate. Another more preferred fluorocarbon is a reaction product of N-ethyl perfluorooctyl-sulfoamideo ethanol with toluene diisocyanate. The aqueous solution of this method may also contain an effective amount of a thiocyanate. The thiocyanate cation may be ammonium, sodium, potassium, copper, zinc, ferrous, ferric, methyl or phenyl, preferred is ammonium. The aqueous solution of this method may also contain an effective amount of a dispersing agent. The dispersing agent can be a condensed naphthalenic salt, alkyl sulfosuccinate or mixtures thereof. The preferred dispersing agent is a mixture of a sodium salt of condensed naphthalenic sulfonic acid and di-isobutyl sulfosuccinate. The aqueous solution of this method may also contain an effective amount of a salt having a divalent cation. The preferred salt is calcium, magnesium, zinc, or ferrous chloride, sulfate or phosphate wherein the most preferred is magnesium sulfate. The preferred aqueous solution would contain the combination of a sulfonated aromatic condensate, a salt containing a divalent cation, a thiocyanate, and a dispersing agent, the most preferred combination would be wherein the condensate is formaldehyde condensed with the alkali metal salt of para-phenol sulfonic acid and with 4,4'-diphenolsulfone, the thiocyanate is ammonium thiocyanate, the divalent cationic salt is magnesium sulfate and the preferred dispersing agents are di-isobutyl sulfosuccinate and the sodium salt of condensed naphthalene sulfonic acid in a mixture. The preferred carpet fabric would comprise a fiber treated with a fluorocarbon. The fluorocarbon is a mixture of pyromellitate oligomers formed by two reactions, first the reaction of pyromellitic dianhydride with a fluorinated alcohol, second, the reaction product of the first reaction further reacted with epichlorohydrin. The amounts of the fluorocarbon present on the carpet fabric used in the method is an amount between about 0.05 and 0.4% by weight of the fabric, the magnesium sulfate can be present in the aqueous solution of the method in an amount between about 0.05 and 0.8% on the weight of the fabric, the ammonium thiocyanate can be present in an amount in about 0.03 to 1% on the weight of the fabric, the sulfonated aromatic condensate can be present in an amount of between about 0.15 and 7.5% on the weight of the fabric, the dialkyl sulfosuccinate can be present in an amount of between 0 and 6 parts by weight to the parts by weight of the sulfonated aromatic condensate and the sodium of the condensed naphthalenic acid can be present in an amount between about 0 and 3 parts by weight to parts by weight of the sulfonated aromatic condensate. The preferred amounts of the compounds are about 0.05 and 0.4% by weight of the fabric of the fluorocarbon, between about 0.08 and 0.4% on the weight of the fabric of the magnesium sulfate, between 0.15 and 0.7% on the weight of the fabric of the ammonium thiocyanate and between about 0.15 and 1.5% on the weight of the fabric of the sulfonated aromatic condensate with the dialkyl sulfosuccinate being present in an amount between 0 and 2.5 parts by weight to the parts by weight of the sulfonated aromatic condensate and the sodium salt of the condensed naphthalenic acid being present in an amount between 0 and 2 parts by weight to parts by weight of the sulfonated aromatic condensate. In order to improve yellowing of the carpet fabric, any of the above aqueous solutions can be buffered with an effective amount of citric acid or any other acid with a sequestering agent. The preferred aqueous solution is buffered with an amount of citric acid between 0.3 and 5.5 grams per liter of aqueous solution.

A two-step process embodiment of this invention uses the aftertreatment process described above but, preceding the initial preheating step of that after treatment an effective amount of the sulfonated aromatic condensate is added during dyeing of the carpet fabric so that the total of effective amounts of sulfonated aromatic condensate in both steps is less than the total effective amount useful in either the first dye step, solely, or in the subsequent application step, solely, or so that a more effective degree of stain resistance of the carpet fabric is achieved at the same total of effective amounts of sulfonated aromatic condensate in the two steps as compared to the same amount in either step solely. An effective amount of the salt having a divalent cation can be added during the dyeing so that the s.a.c. exhausts onto the fiber at the possibly higher pH and so that the stain resistance of the nylon fiber in the carpet fabric, especially an easily dyed nylon fiber having a high index of crystalline perfection and having a very open internal crystal polymer structure, is enhanced and durability steam cleaning of the stain resistance is enhanced, or the effective amount of sulfonated aromatic condensate is lower to achieve the same level of stain resistance. The divalent salt again can be calcium, zinc, magnesium or ferrous sulfate, chloride or phosphate. The preferred salt is magnesium sulfate. The preferred amounts of sulfonated aromatic condensate added during dyeing and after dyeing are between about 0.05% on the weight of the fiber to 0.5% on the weight of the fiber during dyeing, an additional 0.05% on the weight of the fiber to 7.5% on the weight of the fiber after dyeing. Also, the preferred amounts of magnesium sulfate are 0.03 to 1% on the weight of the fiber added to the dyebath and 0.05 to 1% on the weight of the fiber added after dyeing. The carpet fabric used in the method can comprise a fluorocarbon present before dyeing. The fluorocarbon again can contain perfluoroalkyl radical or a mixture of fluorinated pyromellitic oligomers. The preferred fluorocarbon is a mixture of pyromellitic oligomers formed by two reactions, first, the reaction of pyromellitic dianhydride with a fluorinated alcohol, and second, the reaction product of the first reaction further reacted with epichlorohydrin. The preceding dyeing step can either be a continuous dyeing operation or it can be batch or beck dyeing. The beck dyeing can be done in the presence of an effective amount of a salt having a divalent cation so that the stain resistance of the carpet fabric is enhanced. The preferred amount of magnesium sulfate in the dyebath is an amount between 0.2% on the weight of the fiber to 5% on the weight of the fiber.

Another method to improve stain resistance of nylon or wool fiber comprises treating the fiber with a combination of an effective amount of each of a sulfonated aromatic condensate and a thiocyanate, whereby improved resistance to oxidation to ozone or by other strong oxidizing agents such as benzoyl peroxide is imparted to the s.a.c. and the dye on the fiber. The preferred fiber is carpet fiber, the preferred aromatic condensate is sulfonated aromatic formaldehyde condensate formed by condensation with one or more phenols. At least one of the phenols can be a phenol sulfonic acid or the alkali metal salt thereof. Or at least one of the phenols can be a sulfone. The sulfone can be a dihydroxy aromatic diphenolsulfone. The preferred condensate is formaldehyde condensed with a alkali metal salt of para-phenol sulfonic acid and with 4,4'-diphenolsulfone. This method of improving stain resistance of nylon or wool fiber using a thiocyanate with the sulfonated aromatic condensate can use a thiocyanate selected from the group consisting of ammonium, sodium, potassium, copper, zinc, ferrous, ferric, methyl and phenyl thiocyanate. The most preferred is ammonium thiocyanate. The dispersing agent can be added to the mixture applied to the fiber in this method also. The dispersing agent can be selected from the group consisting of condensed naphthalenic salt, an alkyl sulfosuccinate or a mixture thereof. The preferred dispersing agent is a mixture of the sodium salt of condensed napathalene sulfonic acid and di-isobutyl sulfosuccinate. The preferred amounts used in this method are between about 0.05 and 10% on weight of the fiber of the sulfonated aromatic condensate, between about 0.1 and 5% on weight of the fiber of the thiocyanate and the sodium salt of the condensed naphthalenic sulfonic acid is added in an amount between 0 and 3 parts by weight by parts by weight of the sulfonated aromatic condensate and the di-isobutyl sulfosuccinate is added in amount between 0 and 6 parts by weight to the parts by weight of sulfonated aromatic condensate.

Yet another method of improving stain resistance of nylon fiber, particularly fiber having a high index of crystalline perfection, for carpet comprises treating the fiber with a combination of an effective amount each of a sulfonated aromatic condensate, thiocyanate and salt having a divalent cation. The sulfonated aromatic condensate can be a condensate with formaldehyde, can further be formed by the condensation of formaldehyde with one or more phenols and at least one of the phenols can be phenol sulfonic acid and the alkali metal salt thereof or sulfone. The preferred condensate is formaldehyde condensed with a alkali metal salt of para-phenol sulfonic acid and with 4,4'-diphenolsulfone. The preferred thiocyanate is ammonium thiocyanate but the thiocyanate can be ammonium, sodium, potassium, copper, zinc, ferrous, ferric, methyl or phenyl. The preferred salt is magnesium sulfate but the salt can be calcium, magnesium or ferrous chloride, sulfate or phosphate. The fiber treated can comprise an effective amount of the fluorocarbon compound intended to enhance soil resistance of the fiber. The preferred fluorocarbon is a mixture of pyromellitate oligomers formed by two reactions, first the reaction of pyromellitic dianhydride with a fluorinated alcohol and second a reaction product of the first reaction further reacted with epichlorohydrin. A dispersing agent can be added to the combination used to treat the fiber in this method. Dispersing agents can be condensed naphthalenic salt or an alkyl sulfosuccinate or a mixture thereof. The preferred amounts are between 0.15 and 7.5% on weight of the fiber of the sulfonated aromatic condensate between 0.15 and 1% on weight of the fabric of the thiocyanate, between 0.05 and 0.8% on weight of the fabric of the divalent cation salt, and between 0.05 and 0.4% on the weight of the fabric of the fluorocarbon present on the fiber before dyeing. As above the condensate and thiocyanate can be buffered with an effective amount of citric acid or any acid with a sequestering agent so light induced yellowing of the stain resistant fiber is reduced.

A method of improving light induced yellowing of stain resistant nylon in fiber treated with an effective amount of sulfonated aromatic condensate from an aqueous solution comprises using an effective amount of citric acid or any acid with a sequestering agent to buffer the aqueous solution containing the sulfonated aromatic condensate for treating the fiber at a pH between about 1 and 5.5.

Another two-step treatment is a method to dye and treat in two steps (both batch or beck) nylon carpet fabric to impart improved resistance to staining comprising dyeing in a first step in dyed carpet fabric in a dyebath liquor in the presence of an effective amount of a sulfonated aromatic condensate in an aqueous solution at an elevated temperature then removing the dyebath liquor from the dyed carpet fabric then rinsing the dyed carpet fabric then applying in a second step another effective amount of a sulfonated aromatic condensate in an aqueous solution to the dyed carpet fabric at a pH between 1.5 to 5.5 at a liquor temperature between 110° and 195° F. (60° and 91° C.) so that the total of effective amounts of sulfonated aromatic condensate in both steps is less than total effective amount useful in either the first dye steps solely or in a subsequent application step solely or so that a more effective degree of stain resistance of the carpet fabric is achieved at the same total of effective amounts of sulfonated aromatic condensate in said two steps as compared to the same amount in either step solely. The dyeing conditions in the first step are a liquor to fabric ratio of about 10:1 to 100:1 at a temperature of 158 to 212° F. (70° to 100° C.) for 15 to 90 minutes. Preferred conditions for the second step are a liquor to fabric ratio of about 10:1 to 100:1 for a period of about 5 to 60 minutes. The carpet fabric can be also rinsed subsequent to the second step. The sulfonated aromatic condensate can be condensed with formaldehyde. The sulfonated aromatic formaldehyde condensate can be formed by condensation of formaldehyde with one or more phenols. The phenols can be phenol sulfonic acid or the alkali metal salt thereof. Or the phenol can be dihydroxy aromatic diphenol sulfone. The preferred condensate is formaldehyde condensed with alkali metal salt of para-phenol sulfonic acid and with 4,4'-diphenolsulfone. Here again the dyed carpet fabric can comprise an effective amount of a fluorocarbon intended to improve the resistance of soiling of the carpet. The preferred amount of the fluorocarbon is present in an amount of from about 0.05 to 0.4% by weight on weight of the fabric. The fluorocarbon can contain perfluoroalkyl radical or a mixture of fluorinated pyromellitate oligomers. The fluorocarbon can be the reaction product of a perfluoroalkyl alcohol or amide with a suitable anhydride or isocyanate. The fluorocarbon can be the reaction product of N-ethyl perfluorooctylsulfoamideo ethanol with toluene diisocyanate. The preferred fluorocarbon is a mixture of pyromellitate oligomers formed by two reactions, first, the reaction of pyromellitic dianhydride with a fluorinated alcohol, and second, the first reaction product is further reacted with epichlorodrin. The second step aqueous solution can also contain an effective amount of a thiocyanate such as ammonium, sodium, potassium, copper, zinc, ferrous, ferric, methyl or phenyl thiocyanate. The preferred thiocyanate is ammonium thiocyanate. The aqueous solution of either or both application steps can also contain an effective amount of dispersing agent such a condensed naphthalenic salt, an alkyl sulfosuccinate or a mixture thereof. The preferred dispersing agent is a mixture of the sodium salt of condensed naphthalene sulfonic acid and di-isobutyl sulfosuccinate. The aqueous solutions of both steps of this invention can also contain an effective amount of salt having divalent cation such calcium, magnesium or ferrous chloride, sulfate or phosphate, preferably magnesium sulfate. The preferred amounts of this method would be having the fluorocarbon present in an amount of 0.05 and 0.4% by weight of the fabric, magnesium sulfate present in an amount of between 0.25 and 4% on the weight of the fabric, ammonium thiocyanate present in an amount between 0.03 and 1% on the weight of the fabric, the sulfonated aromatic formaldehyde condensate present in an amount between 0.15 and 7.5% on the weight of the fabric and the dialkyl sulfosuccinate present in an amount betwen 0 and 6 parts by parts by weight of the sulfonated aromatic condensate and the sodium salt of a condensed naphthalenic acid is present in an amount between 0 and 3 parts by weight by parts by weight of sulfonated aromatic condensate. The more preferred amounts are where the fluorocarbon is present in an amount of between about 0.05 and 0.4% on the weight of the fabric, the magnesium sulfate is present in an amount between 0.25 and 1.5% on the weight of the fabric, ammonium thiocyanate is present in an amount between 0.05 and 0.75% on the weight of the fabric, sulfonated aromatic formaldehyde condensate is present in an amount between 0.15 and 2.0% on the weight of the fabric and the dialkyl sulfonsuccinate is present in an amount between 0 and 2.5 parts by weight to the parts by weight of the sulfonated aromatic condensate and the sodium salt of a condensed naphthalenic acid is present in an amount between 0 and 2 parts by weight to the parts by weight of the sulfonated aromatic condensate. Here again aqueous solution can be buffered with an effective amount of citric acid or any other acid with a sequestering agent to improve the yellowing of the carpet fabric.

Finally, in the last embodiment of this invention a method of improving exhaustion of a water soluble thiocyanate onto polyamide fiber comprising contacting the fiber with an effective amount of the thiocyanate at a pH between about 1 and 5 wherein the fiber has improved resistance to fading of dye, due to strong oxidizing agents such as benzoyl peroxide or ozone, the dye being present in or on the fiber, is disclosed. The thiocyanate can be ammonium, sodium, potassium, copper, zinc, ferrous, ferric, methyl or phenyl thiocyanate. The preferred pH of the method is between 1 and 4. The preferred amount of thiocyanate is between about 0.1 and 6% on the weight of the fiber of the thiocyanate, present in or on the fiber after dyeing. The method improves exhaustion so that between about 0.1 and about 12% on the weight of the fiber of the thiocyanate is present during the contacting and at least 50% of the thiocyanate present during the contacting is exhausted onto or into the fiber. The preferred thiocyanate is ammonium thiocyanate. The thiocyanate can be contacted with the fiber in the dyebath or after dyeing of the fiber. The fiber being treated can comprise an effective amount of a fluorocarbon to inhibit soiling of the fiber and a sulfonated aromatic condensate can be present either on the fiber or with the thiocyanate. The various fluorocarbons are as described above. An effective amount of citric acid or any acid with a sequestering agent can also be used to buffer for the condensate and thiocyanate to the desired pH for this same anti-yellowing effect. It is preferred to have between about 0.1 and 12% thiocyanate on the weight of the fiber and between about 0.05 and 0.4% fluorocarbon on the weight of the fiber.

PREFERRED EMBODIMENTS

Continuous Aftertreatment Process

This process is intended to continuously treat nylon carpet fabric with sulfonated aromatic condensate formulations, for instance on a continuous dye range after steaming but before washing; or piece (or beck) dyed carpets may be continuously treated in a similar fashion by treating in-line on the wet goods dryer range prior to the dryer. Equipment could be a spray header(s), or the equivalent, for the heated water across the moving carpet fabric with vacuum extractors below or a set of squeeze rolls to remove the water, followed by spray headers for the treatment liquor with a catch pan underneath. An alternative to spray application is use of a pressurized applicator, such as a Kusters Fluidyer, which presses the carpet into contact with a narrow slot in a conduit containing treatment liquor under pressure.

The prior art describes the application of similar sulfonated aromatic formaldehyde condensates by a beck (piece) aftertreatment and a continuous manner along with dyestuffs and subsequent steaming. The continuous process of this invention has economical advantages over the beck aftertreatment process by approximately 4 cents per pound of fiber produced as finished carpet (at equal levels of the stain resist agent on the fiber). The continuous aftertreatment process of this invention has the following advantages over the known prior art processes:

(a) Post dyeing process. Process conditions are optimized for the "exhaustion" of the sulfonated aromatic formaldehyde condensate onto the fiber. These conditions are not necessarily compatible with the dyeing process. Since the treatment process occurs after dyeing, there is no interference with the dyeing process. Prior art concurrent (with dyes) processes generally result in poorer dyeing quality, a loss in dye yield and an effect of the dyed shade of the carpet.

(b) More versatile. The process of this invention is applicable to both continuously dyed solid or multicolor patterns with the same process conditions. Furthermore, the process is also applicable to continuously aftertreating piece (or beck) dyed goods at the wet goods dryer.

The process involves the general principle of first, preheating the carpet with heated water followed by hydroextraction and the application of an aqueous solution of the sulfonated aromatic formaldehyde condensate, for which there are specific ranges of pH, concentration, wet pick-up (w.p.u.) and temperatures. This is followed by a dwell period at which the carpet is either held at temperature or is allowed to radiant cool prior to washing the carpet. Prior to the treatment, the carpet has already been dyed by either beck or continuous methods. For beck-dyed carpets the treatment process is at the wet goods dryer and for continuously-dyed carpets the treatment process is in-line after steaming and prior to the final washing step.

The process, in more detail, involves preheating the dyed carpet with hot water followed by hydroextraction by either squeeze or vacuum methods to a wet pick-up of 30 to 190%. The conditions of the preheating process are established to achieve a carpet temperature of 130° to 210° F. (54.4 to 99° C.) prior to the treatment stage. The conditions of the preheating process are generally using 200% w.p.u. to total saturation with water at 140° to 212° F. (60° to 100° C.). As an addition in the continuous dyeing process, this also gives the carpet a washing prior to application of the treatment solution which aids the carpet's receptiveness to the stain resist agent. The treatment solution is an aqueous solution of the sulfonated aromatic condensate at a 0.25 to 40 grams per liter concentration and a pH of 1.5 to 5.5. The treatment solution is applied at 200 to 600% w.p.u. add-on and a temperature of 140° to 212° F. (60° to 100° C.). The resulting temperature of the carpet must be in the 130° to 210° F. (54.4° to 99° C.) range for the treatment to be effective. It is preferred to keep the difference in carpet fabric temperature between pretreating and application to a minimum. Following the application of the treatment liquor, it is necessary to either maintain the carpet at the application temperature for at least 0.5 to 30 seconds or allow it to radiantly cool to no less than 130° F. (54.4° C.).

The equipment used for the application of the treatment liquor may be either spray or contact (e.g. Kusters Fluidyer) in nature. The contact method is preferred since it is easier to achieve 100% penetration of the treatment. Spray processes are adequate provided that the solution penetrates to the back of the carpet, and will generally require additional mechanical considerations, such a squeeze or "S" rollers to achieve complete penetration. Other application equipment may also be used as long as the process requirements of preheating, heated treatment and dwell time at temperature are satisfied. The preheating and/or extracting steps of this invention may be carried out on the previously existing equipment.

The practical significance of this invention is that it provides an economical and effective means to apply sulfonated aromatic formaldehyde condensates to impart stain resistance to dyed carpets. The process is applicable to over 90% of all carpets treated with sulfonated aromatic formaldehyde condensates.

The continuous aftertreatment embodiment can also be the second step of another *two*-step process embodiment of this invention wherein an effective amount of the sulfonated aromatic condensate is added to a continuous dyebath or in batch or beck process for dyeing carpet fabric. The two-step process uses less overall amount sulfonated aromatic condensate for the same effect level of stain resistance. Alternatively, the same total amount of sulfonated aromatic condensate can be used in the two-step process to achieve a higher level of stain resistance.

Certain nylon substrates (fiber) have very open internal structure (orientation of the polymer chains) which require very high amounts of the sulfonated aromatic condensate composition to impart a marketable degree of stain resistance. Certain sulfonated aromatic condensate compositions cannot achieve a sufficient level of protection on these substrates, so they must be excluded. Also, the continuous aftertreatment method results in only moderate durability of the stain resistance properties to steam cleaning when a high pH detergent is used.

The two-step application process has all of the advantages of the continuous aftertreatment process such as economics, etc. over one-step batch processes. It also has unique advantages over the aftertreatment process alone and all other known continuous application processes for sulfonated aromatic condensates, such as using all of the sulfonated aromatic condensate in dyebath (currently being practiced on a commercial scale).

The level of stain resistance imparted by a given total amount of the sulfonated aromatic condensate is substantially improved. The required add-on for a marketable level of stain resistance reduced by approximately 30% over aftertreatment and greater for other continuous processes, providing economical advantages. The process (with optimized sulfonated aromatic condensate composition for aftertreatment) yields marketable levels of stain resistance on critical substrates described above using reasonable levels of the sulfonated aromatic condensate composition. The durability of the stain resistance properties to steam cleaning (with and without a high pH detergent) is improved over the aftertreatment only process, yielding improved properties.

The two-step process involves the general principle of applying a portion of the total sulfonated aromatic condensate composition to be applied in the standard dyebath with an appropriate amount of magnesium sulfate (magnesium sulfate, 0 to 0.35% on the weight of the fabric for each 1% on the weight of the fabric of the sulfonated aromatic condensate). The balance of the total sulfonated aromatic condensate composition (with 0 to 0.35% of magnesium sulfate) is then applied as an aftertreatment. The amount of Epsom Salt required in both portions depends on the sulfonated aromatic condensate and the substrate being treated.

The dyebath composition is based on that typically used for continuous dyeing. The appropriate amount of the sulfonated aromatic condensate composition (based on the optimum ratio and the total required for the particular substrate) is added to the dyebath.

More specific examples of the processes are given in the following Examples.

Preferred Treatment Compositions

In addition to a sulfonated aromatic condensate other chemical compounds such as a thiocyanate are added to the formulation used to treat the carpet fabric to overcome oxidative yellowing of the sulfonated aromatic condensate, and to provide the resulting carpet with better resistance of the dyes to strong oxidizing agents, such as ozone or the benzoyl peroxide found in commercial anti-acne preparations. Also a salt containing a divalent cation is useful to improve exhaustion of the sulfonated aromatic condensate on high ICP polymer fibers. A dispersing agent(s) is usually necessary in the formulation to prevent precipitation or coagulation due to incompatibility of the components of the formulation for treatment and/or the components with a fluorocarbon treated carpet fabric. Acids are used to buffer the formulations. It has been discovered that citric acid or any acid with a sequestering agent creates an additional improvement in yellowing characteristics of sulfonated aromatic condensate treated fiber or fabric.

Ammonium thiocyanate and sulfonated aromatic condensates exhaust onto nylon fibers under comparable application procedures. The two products may be co-applied providing that the uptake of one material does not interfere with the other. Therefore, the selection of the sulfonated aromatic condensate is important. Some sulfonated aromatic condensates exhaust preferentially over ammonium thiocyanate. But to the contrary there was a synergistic effect of Intratex N (which is reported to be formaldehyde condensed with an alkali metal salt of para-phenol sulfonic acid and with 4,4'-diphenolsulfone) and ammonium thiocyanate on benzoyl peroxide spotting resistance.

An additional benefit of ammonium thiocyanate in the composition is as an antioxidant to prevent light induced yellowing of Intratex N. This combination was found to give a sufficient improvement (acceptable light fastness) for beck applications, but was insufficient for continuous applications (although improved).

The combination of sequestering agents, such as EDTA and sodium hexametaphosphate, with Intratex N was found to result in some improvement in light induced yellowing, but did not yield completely acceptable results for the continuous application. Combination of Intratex N with citric acid (sequestering and antioxidant properties) also gave similar results. The combination of ammonium thiocyanate and citric acid was discovered to achieve the best results in the reduction of light induced yellowing for continuous application, showing virtually no yellowing. (Combinations of ammonium thiocyanate and other sequestering agents were not as effective.)

A novel dispersant system, using Tamol SN and Monawet MB-45 was developed to prepare a stable composition containing Intratex N, ammonium thiocyanate and citric acid in concentrated form for continuous applications. A new dispersant system was developed to prepare a stable concentrate containing Intratex N and ammonium thiocyanate for beck aplications.

| Component | Example Compositions: Composition 1, % | Solids, % | Composition 2, % | Solids, % |
|---|---|---|---|---|
| Intratex N* (s.a.c.) | — | — | 18.9 | 3.8 |
| Intratex N-1* | 25 | 5 | — | — |
| Ammonium Thiocyanate | 6.00 | 6 | — | — |
| Citric Acid (50% solution) | 14.30 | 7.15 | — | — |
| Sulfuric Acid | — | — | 1.11 | 1.1 |
| Tamol SN (sodium salt of condensed naphthalene sulfonic acid) | 4.00 | 3.9 | 7.32 | 7.1 |
| Monawet MB-45 (di-isobutyl sulfosuccinate) | 20.00 | 9 | — | — |
| Epsom Salt | 6.00 | 6 | — | — |
| (Magnesium Sulfate) | 24.7 | 2.9 | | |
| Demineralized Water | 33.03 | 0 | 72.65 | 0 |

*Same concentration of same s.a.c., N-1 has pH 7, N has pH 10.5.

Any thiocyanate such as those listed in the Summary of the Invention is expected to be effective, although the copper, ferrous and ferric thiocyanates may have to be color compensated.

As dispersing agents any agent that is effective can be used, such as for any process formulation, the condensed naphthalenic salts, the alkyl sulfosuccinates, a mixture of them, and for batch process systems salts of polymeric carboxylic acid, and polyethylene glycol ethers.

As sequestering agents, the polyphosphates, such as sodium tripolyphosphate (STPP), aminocarboxylic acids, such as ethylenediamine tetraacetic acid (EDTA), hydroxycarboxylic acids, such as tartaric and citric acid, and the aminoalcohols, such as triethanolamine (TEA) are expected to be effective. See Kirk-Othmer Encyclopedia of Chemical Technology, supra.

EXAMPLE 1

On a commercial dyeing range Composition 1 was applied both in a two-step (continuous-continuous) and in a continuous aftertreatment only process to a normal and to a high ICP fiber carpet fabric. The normal fiber was in an 1186 denier Superba heat set textured yarn. The high ICP fiber was a 1700 denier textured yarn which was heat set by a proprietary Pharr process with a high heat history giving an ICP of 3.92 co:npared tO normal ICP of about 3.8. Both fibers were previously treated with a spin finish containing a soil-release fluorocarbon as described in U.S. Pat. No. 4,604,316 and/or U.S. Pat No. 4,192,754. The fabric was dyed gray. The prewash and treatment application was by spray just after the dryer but before the final wash on the continuous dye range. Following are the dyes and chemicals used in the continuous dyebath.

Control

H 0.135 g/l** Nylanthrene[1] Orange RAR (liquid)
092 g/l Tectilon[2] Red 2B Liq.-50
0.052 g/l Telon[3] Blue B-AR (powder)
(the above dyes are the same for all dyebaths.)
3.0 g/l Alrowet[2] D-70 *
1.0 g/l Chemcogen[4] DCG *
0.5 g/l Defoamer AC (Fuller) *
pH 5.5 with Acetic Acid
400% w.p.u. via Kuster Fluidyer
Steam in vertical steamer 5 to 6 minutes

"4% Dyebath"

(Order of addition to bath as listed.)
3.0 g/l Alrowet D-70
1.0 g/l Chemcogen DCG
0.5 g/l Defoamer AC (Fuller)
10.0 g/l Composition 1
1.25 g/l Epsom Salt (Magnesium Sulfate)
0.5 g/l Sequestrene[2] 30A *
Dyes above
Approximately 1 g/l Ammonia to pH 5.5

"8% Dyebath"

(Order of addition to bath as listed.)
3.0 g/l Alrowet D-70
1.0 g/l Chemcogen DCG
0.5 g/l Defoamer AC (Fuller)
20.0 g/l Composition 1
2.5 g/l Epsom Salt (Magnesium Sulfate)
0.5 g/l Sequestrene 30A *
Dyes above
Approximately 3 g/l Ammonia to pH 5.5 L6 *Alrowet D-70 is dioctyl sulfosuccinate—70% active. Chemcogen DCG is sulfonate alkyl diphenylether—30–38 % active. Defoamer AC is a proprietary defoamer from Fuller Sales. Sequestrene 30A is ethylene diamine tetraacetic acid.

1 TM of Crompton & Knowles 2 TM of Ciba Geigy 3 TM of Mobay 4 TM of Lyndal Chem. ** grams per liter The following tables provide other operating conditions and results, using the above dyebaths and the shown aftertreatments. Trials 3 and 4 were omitted because they had a slightly different, nonpreferred, formulation.

TABLE I

Aftertreatment (A/T) Application Data

| Trial I.D.* | Nominal Comp. 1 Add-on from Dyebath, % owf | Nominal Comp. 1 Add-on from A/T, % owf | Total Nominal Comp. 1 Add-on, % owf | Preheat Liquor Temperature, °F. | (°C.) |
|---|---|---|---|---|---|
| 1 | 0 | 0 | 0 | 142 | (61.1) |
| 5 | 0 | 11.0 | 11.0 | 140 | (60.0) |
| 9 | 4.0 | 7.0 | 11.0 | 141 | (60.6) |
| 10 | 4.0 | 11.0 | 15.0 | 140 | (60.0) |
| 2 | 0 | 0 | 0 | 142 | (61.1) |
| 6 | 0 | 10.9 | 10.9 | 140 | (60.0) |
| 8 | 4.0 | 7.0 | 11.0 | 141 | (60.6) |
| 7 | 0 | 14.9 | 14.9 | 140 | (60.0) |
| 11 | 4.0 | 10.9 | 14.9 | 140 | (60.0) |
| 12 | 8.0 | 7.0 | 15.0 | 140 | (60.0) |
| 13 | 8.0 | 11.0 | 19.0 | 140 | (60.0) |

| Trial I.D.* | Carpet Temperature Before A/T, °F. | (°C.) | A/T Liquor, pH | Post-A/T Carpet Temperature, °F. | (°C.) |
|---|---|---|---|---|---|
| 1 | 128 | (53.3) | 7.6 | 157–159 | (69.4–70.6) |
| 5 | 127–129 | (52.8–53.9) | 2.9 | 155–156 | (68.3–68.9) |
| 9 | 129–130 | (53.9–54.4) | 3.0 | 158–159 | (70.0–70.6) |
| 10 | 128–129 | (53.3–53.9) | 2.9 | 155–157 | (68.3–69.4) |
| 2 | 128 | (53.3) | 7.6 | 156–158 | (68.9–70.0) |
| 6 | 127–129 | (52.8–53.9) | 2.9 | 158–160 | (70.0–71.1) |
| 8 | 128–131 | (53.3–55.0) | 3.0 | 158–159 | (70.0–70.6) |
| 7 | 128–129 | (53.3–53.9) | 2.8 | 160–162 | (71.1–72.2) |
| 11 | 129–131 | (53.9–55.0) | 2.9 | 157–158 | (69.4–70.0) |
| 12 | 129–130 | (53.9–54.4) | 3.0 | 160–161 | (71.1–71.7) |

TABLE I-continued

| Aftertreatment (A/T) Application Data | | | | | |
|---|---|---|---|---|---|
| 13 | 130 | (54.4) | 2.9 | 157–159 | (69.4–70.6) |

*Numbers 1, 5, 9 and 10 trials are normal crpet fabric; remaining numbers are high ICP carpet fabric. Trials 1 and 2 are a controls.
Both fabrics are 40 oz/sq yd cut piles.
A/T Liquor Temperature ranged from 180–182° F. (82.2–83.3° C.).

TABLE II

SOLUTION AND CARPET ANALYSIS DATA

| | Concurrent Portion (in Dyebath) | | | |
|---|---|---|---|---|
| Trial I.D. | Target Nominal Comp. 1 Add-on, % owf | Nominal Comp. 1 Conc. in Dyebath, g/l | Anal. Comp. 1 Conc. in Dyebath, g/l | Calc. Comp. 1 Add-on from Analysis, % owf |
| 1 | 0 | 0 | 0 | 0 |
| 2 | 0 | 0 | 0 | 0 |
| 5 | 0 | 0 | 0 | 0 |
| 6 | 0 | 0 | 0 | 0 |
| 7 | 0 | 0 | 0 | 0 |
| 8 | 4.0 | 10.0 | 9.2 | 3.7 |
| 9 | 4.0 | 10.0 | 9.2 | 3.7 |
| 10 | 4.0 | 10.0 | 9.2 | 3.7 |
| 11 | 4.0 | 10.0 | 9.2 | 3.7 |
| 12 | 8.0 | 20.0 | 16.8 | 6.7 |
| 13 | 8.0 | 20.0 | 16.8 | 6.7 |

| | Aftertreatment Portion | | | |
|---|---|---|---|---|
| Trial I.D. | Target Nominal Add-on, % owf | Conc. Deliv., GPM* | Actual A/T Spray Header Pres., psig | Total A/T Liquor Deliv., GPM* |
| 1 | 0 | 0 | 6.7 | 77 |
| 2 | 0 | 0 | 6.6 | 76 |
| 5 | 11.2 | 1.19 | 6.5 | 75 |
| 6 | 11.2 | 1.19 | 6.6 | 76 |
| 7 | 15.2 | 1.62 | 6.6 | 76 |
| 8 | 7.2 | 0.76 | 6.6 | 76 |
| 9 | 7.2 | 0.76 | 6.6 | 76 |
| 10 | 11.2 | 1.19 | 6.7 | 77 |
| 11 | 11.2 | 1.19 | 6.7 | 76 |
| 12 | 7.2 | 0.76 | 6.6 | 76 |
| 13 | 11.2 | 1.19 | 6.5 | 75 |

| | Aftertreatment Portion | | | |
|---|---|---|---|---|
| Trial I.D. | Calc. Nominal A/T Liquor Conc., g/l | Anal. A/T Liquor Conc., g/l | Calc. Comp. 1 Add-on from Set-up, % owf | Calc. Comp. 1 Add-on from Analysis, % owf |
| 1 | 0 | 0 | 0 | 0 |
| 2 | 0 | 0 | 0 | 0 |
| 5 | 17.4 | 14.8 | 11.0 | 9.3 |
| 6 | 17.2 | 14.8 | 10.9 | 9.4 |
| 7 | 23.3 | 22.4 | 14.9 | 14.3 |
| 8 | 11.0 | 11.6 | 7.0 | 7.4 |
| 9 | 11.0 | 11.6 | 7.0 | 7.4 |
| 10 | 17.0 | 18.4 | 11.0 | 11.9 |
| 11 | 17.2 | 18.4 | 10.9 | 11.7 |
| 12 | 11.0 | 11.2 | 7.0 | 7.1 |
| 13 | 17.4 | 13.6 | 11.0 | 8.6 |

| | Concurrent and Aftertreatment Portion | | | | |
|---|---|---|---|---|---|
| Trial I.D. | Target Comp. 1 Add-on % owf | Calc. Comp. 1 Add-on from Set-up, % owf | Calc. Comp. 1 Add-on from ANALYSIS, % owf | Anal. Comp. 1 Add-on from Carpets, % owf | Anal. s.a.c. Add-on from Carpets, % owf |
| 1 | 0 | 0 | 0 | 0 | 0 |
| 2 | 0 | 0 | 0 | 0 | 0 |
| 5 | 11.2 | 11.0 | 9.3 | 10.6 | 2.6 |
| 6 | 11.2 | 10.9 | 9.4 | 10.9 | 2.7 |
| 7 | 15.2 | 14.9 | 14.3 | 16.3 | 4.0 |
| 8 | 11.2 | 11.0 | 11.1 | 10.7 | 2.6 |
| 9 | 11.2 | 11.0 | 11.1 | 11.1 | 2.7 |
| 10 | 15.2 | 15.0 | 15.6 | 14.0 | 3.5 |
| 11 | 15.2 | 14.9 | 15.4 | 15.4 | 3.8 |
| 12 | 15.2 | 15.0 | 13.8 | 15.8 | 3.9 |
| 13 | 19.2 | 19.0 | 15.3 | 19.6 | 4.9 |

TABLE II-continued

SOLUTION AND CARPET ANALYSIS DATA

Line speed for both fabrics was 30 ft/min.
Throughput = 99.8 lb carpet/min.
Actual dyeing wet pick-up was 400% in all cases.
Aftertreatment wet pick-up was always between 626 and 643%.
Aftertreatment pH was always between 2.8 and 3.0 except control was 7.6.
*gallons per minute

TABLE III

STAINING DATA

| Trial I.D. | Nominal Comp. 1 Add-on from Dyebath, % owf | Nominal Comp. 1 Add-on from A/T, % owf | Total Nominal Comp. 1 Add-on, % owf |
|---|---|---|---|
| 1 | 0 | 0 | 0 |
| 5 | 0 | 11.0 | 11.0 |
| 9 | 4.0 | 7.0 | 11.0 |
| 10 | 4.0 | 11.0 | 15.0 |
| 2 | 0 | 0 | 0 |
| 6 | 0 | 10.9 | 10.9 |
| 8 | 4.0 | 7.0 | 11.0 |
| 7 | 0 | 14.9 | 14.9 |
| 11 | 4.0 | 10.9 | 14.9 |
| 12 | 8.0 | 7.0 | 15.0 |
| 13 | 8.0 | 11.0 | 19.0 |

| | Stain Rating[1] (0 = best 10 = worst) Time Before Blotting with Water, Hours | | | | | |
|---|---|---|---|---|---|---|
| Trial I.D. | 1 | 4 | 7 | 24 | 4 | 24 |
| | Originals | | | | After s.c.* | |
| 1 | 8.5 | 8.5 | 8.5 | 8.5 | 8.5 | 8.5 |
| 5 | 0.25 | 0.25 | 0.25 | 0.25 | 4.5 | 5.0 |
| 9 | 0 | 0 | 0 | 0 | 3.5 | 4.5 |
| 10 | 0 | 0 | 0 | 0 | 3.0 | 4.0 |
| 2 | 9.0 | 9.0 | 9.0 | 9.0 | 8.0 | 8.5 |
| 6 | 2.5 | 2.5 | 2.5 | 2.5 | 4.5 | 5.5 |
| 8 | 0.1 | 0.5 | 0.1 | 0.25 | 2.5 | 4.0 |
| 7 | 0.25 | 1.5 | 1.5 | 1.5 | 5.0 | 6.0 |
| 11 | 0 | 0.1 | 0.1 | 0.25 | 3.0 | 4.0 |
| 12 | 0 | 0 | 0 | 0.1 | 1.0 | 2.0 |
| 13 | 0 | 0 | 0 | 0 | 1.0 | 1.0 |

*steam cleaning
2 passes of detergent solution using conventional steam cleaning equipment. Detergent solution: 1 oz./gal. ALL-IN-ONE (Certified Chemical & Equipment, Cleveland, OH).
[1]See Example 6, Part 2, "Performance", "Drop Test".

TABLE IV

REPELLENCY AND COLORFASTNESS DATA

| Trial I.D. | Comp. 1 Add-on from Dyebath, % owf | Comp. 1 Add-on from A/T, % owf | Total Nominal Comp. 1. Add-on, % owf | Repellency[3] Oil | Repellency[3] Water |
|---|---|---|---|---|---|
| 1 | 0 | 0 | 0 | 5.0 | 4.0 |
| 5 | 0 | 11.0 | 11.0 | 5.0 | 4.0 |
| 9 | 4.0 | 7.0 | 11.0 | 4.0 | 4.0 |
| 10 | 4.0 | 11.0 | 15.0 | 4.5 | 3.5 |
| 2 | 0 | 0 | 0 | 5.0 | 5.0 |
| 6 | 0 | 10.9 | 10.9 | 5.0 | 4.0 |
| 8 | 4.0 | 7.0 | 11.0 | 5.0 | 5.0 |
| 7 | 0 | 14.9 | 14.9 | 5.0 | 4.0 |
| 11 | 4.0 | 10.9 | 14.9 | 4.0 | 4.0 |
| 12 | 8.0 | 7.0 | 15.0 | 4.0 | 4.0 |
| 13 | 8.0 | 11.0 | 19.0 | 4.0 | 3.5 |

| | Grey Scale Rating | | | | | |
|---|---|---|---|---|---|---|
| Trial | Lightfastness | | Ozonefastness[1] | | | $NO_2$[2] Fastness |
| I.D. | 20 AFU* | 40 AFU | 1 cy** | 3 cy | 5 cy | 1 cy** |

TABLE IV-continued

| REPELLENCY AND COLORFASTNESS DATA | | | | | | |
|---|---|---|---|---|---|---|
| 1 | 4.5 | 4.0 | 3.0 | 2.0 | 1.5 | 3.0 |
| 5 | 4.5 | 4.0 | 3.5 | 3.0 | 2.5 | 2.5 |
| 9 | 4.5 | 4.0 | 3.5 | 3.0 | 2.5 | 3.0 |
| 10 | 4.5 | 4.0 | 3.5 | 3.0 | 2.5 | 3.0 |
| 2 | 4.0 | 3.5 | 3.0 | 2.0 | 1.5 | 3.0 |
| 6 | 4.0 | 4.0 | 3.0 | 2.5 | 2.5 | 2.5 |
| 8 | 4.5 | 4.0 | 3.5 | 3.0 | 2.5 | 3.0 |
| 7 | 4.0 | 4.0 | 3.0 | 3.0 | 2.5 | 2.5 |
| 11 | 4.0 | 3.75 | 3.5 | 3.0 | 3.0 | 3.0 |
| 12 | 4.0 | 3.25 | 3.0 | 3.0 | 2.5 | 2.5 |
| 13 | 3.5 | 3.0 | 3.0 | 3.0 | 2.5 | 2.5 |

*AATCC 16E fading unit
**cycles
[1]AATCC 129
[2]AATCC 164
[3]Oil Repellency - AATCC TM-118, Oil Repellency: Hydrocarbon Resistance Test.
Water Repellency
DuPont Isopropanol/water series
1. 2/98 IPA/Water (55)
2. 5/95 IPA/Water (47)
3. 10/90 IPA/Water (40
4. 20/80 IPA/Water (33)
5. 30/70 IPA/Water (28)
Numbers in parentheses represents surface tension of the test fluids.

TABLE V

BENZOYL PEROXIDE SPOTTING DATA*

| Trial I.D. | Comp. 1 Add-on from Dyebath, % owf | Comp. 1 Add-on from A/T, % owf | Total Nominal Agent Add-on, % owf | Spot Visibility 0 = Invisible; 10 = Bright Benzoyl Peroxide Conc., % Soln. in Acetone .01 | .05 | .10 | 1.0 | 5.0 |
|---|---|---|---|---|---|---|---|---|
| 1 | 0 | 0 | 0 | 6.5 | 7.0 | 8.0 | 9.0 | 9.0 |
| 5 | 0 | 11.0 | 11.0 | 0 | 1.0 | 2.0 | 4.5 | 5.5 |
| 9 | 4.0 | 7.0 | 11.0 | 0 | 1.0 | 2.0 | 5.5 | 6.0 |
| 10 | 4.0 | 11.0 | 15.0 | 0 | 2.0 | 2.0 | 5.5 | 6.0 |
| 2 | 0 | 0 | 0 | 5.0 | 6.5 | 6.5 | 9.0 | 9.0 |
| 6 | 0 | 10.9 | 10.9 | 0 | 1.0 | 1.5 | 5.0 | 6.0 |
| 8 | 4.0 | 7.0 | 11.0 | 0 | 1.0 | 2.0 | 6.0 | 6.5 |
| 7 | 0 | 14.9 | 14.9 | 0 | 0.5 | 1.0 | 4.5 | 6.0 |
| 11 | 4.0 | 10.9 | 14.9 | 0 | 1.0 | 2.0 | 5.0 | 5.5 |
| 12 | 8.0 | 7.0 | 15.0 | 0 | 0.5 | 1.5 | 4.5 | 5.5 |
| 13 | 8.0 | 11.0 | 19.0 | 0 | 0.5 | 1.5 | 5.0 | 5.5 |

*Sample spotted with 1-ml of benzoyl peroxide solution and exposed in chamber at 90° F. (32.2° C.) and 80% R.H. for three days (color change ceases).

TABLE VI

SOILING DATA

| Trial I.D. | Comp. 1 Add-on from Dyebath, % owf | Comp. 1 Add-on from A/T, % owf | Total Nominal Comp. 1 Add-on, % owf | Soil Rating (0 = best, 10 = worst) Treads Accl.* Method 5K | JTCC** 5K | JTCC** 10K | Total Soil Rating |
|---|---|---|---|---|---|---|---|
| 1 | 0 | 0 | 0 | 5.0 | 5.5 | 7.0 | 17.5 |
| 4 | 0 | 10.9 | 10.9 | 5.5 | 6.0 | 7.0 | 18.5 |
| 5 | 0 | 11.0 | 11.0 | 5.5 | 6.0 | 7.5 | 19.0 |
| 9 | 4.0 | 7.0 | 11.0 | 4.5 | 6.0 | 7.5 | 18.0 |
| 10 | 4.0 | 11.0 | 15.0 | 4.5 | 6.0 | 7.5 | 18.0 |
| 2 | 0 | 0 | 0 | 5.5 | 4.0 | 5.5 | 15.0 |
| 3 | 0 | 10.9 | 10.9 | 5.5 | 4.5 | 6.0 | 16.0 |
| 6 | 0 | 10.9 | 10.9 | 5.5 | 5.5 | 6.5 | 17.5 |
| 8 | 4.0 | 7.0 | 11.0 | 4.0 | 5.0 | 7.0 | 16.0 |
| 7 | 0 | 14.9 | 14.9 | 5.5 | 5.5 | 7.0 | 18.0 |
| 11 | 4.0 | 10.9 | 14.9 | 4.0 | 4.5 | 7.0 | 15.5 |
| 12 | 8.0 | 7.0 | 15.0 | 4.5 | 5.5 | 7.0 | 17.0 |
| 13 | 8.0 | 11.0 | 19.0 | 4.5 | 5.5 | 7.0 | 17.0 |

*Accelerated soiling conducted at Petersburg Rehabilitation Center using "natural soil" with 2.5% mineral oil added.
**John Tyler Community College Maintenance Hall.

Example 1—Conclusions

The two-step process with composition gives considerably better stain resistance than the aftertreatment (only) process, at equal total add-on levels. This shows potential for achieving acceptable performance at lower total add-on levels.

The two-step process also gives acceptable stain resistance on the "high ICP" substrate at levels comparable to that currently being used for s.a.c. normal substrates by aftertreatment only.

Stain resistnace improves and lightfastness is adversely effected (yellowing) as the Composition 1 concentration in the concurrent portion increases, with total add-on level constant. Acceptable yellowing and stain resistance was achieved at 4% on the weight of the fiber of Composition 1 in the concurrent portion.

"Optimum" two-step systems had improved ozone and benzoyl peroxide (B.P.) spotting resistance properties. Some reduction does occur as the concentration applied by the aftertreatment portion is reduced in favor of the concurrent portion.

Example 1—Summary of Results

Staining Performance Table III

In general, the standard Superba heat set (H/S) substrate performed beter than the high ICP substrate at equivalent application conditions, while analyzed add-on's were equal. This is normally observed because of undesired deep penetration of s.a.c. into fiber of high ICP.

When applied by aftertreatment only, Composition 1 on the high ICP fabric did not yield acceptable staining performance. When the level of Composition 1 was increased from 11 to 15% owf on the high ICP fabric, stain resistance was further improved to a "Marginal" performance level (stain rating of 1.5 at 4- and 24-hour blot times).

The two-step process gave considerably better stain resistance than the aftertreatment only process on both substrates, at equal total application levels. No staining at 24 hours was obtained on the Superba H/S fabric using 4% on the weight of the fiber in the Dyebath and 7% on the weight of the fiber in the A/T. These same levels on the high ICP substrate gave staining performance equal to the Superba fabric aftertreated (only) with 11% on the weight of the fiber of Composition 1 (stain rating of 0.5 at 24 hours).

Example 1—Summary of Results

Colorfastness Table IV

No light induced yellowing was observed at 20 AFU on any of the trials conducted, but begn to be noticed at 40 AFU.

Light induced yellowing (at 40 AFU) became more noticeable as the amount in the concurrent portion was increased (and aftertreatment was reduced). Trials with 8% on the weight of the fiber Composition 1 in the concurrent portion (high ICP substrate) were marginal to unacceptable for lightfastness.

The improvement in resistance to ozone fading, obtained with Composition 1 by aftertreatment was also observed with Composition 1 and also using the two-step process with Composition 1 (at lower level).

Benzoyl Peroxide Spotting Table V

The two-step process gave only a slight reduction in the benzoyl peroxide spotting performance than the aftertreatment process, at equal add-on levels.

Repellency Table IV

There was no significant effect in any of the trials on oil and water repellency. As the amount of Composition 1 (and magnesium sulfate) in the concurrent portion was increased, the oil repellency tended to decrease slightly.

Soiling Table VI

Only a slight negative effect in soiling was observed on all trial samples compared to the control.

Composition 1 showed slightly more soiling when applied by aftertreatment, as the concentration applied was increased.

With total add-on constant, the two-step process had less impact on soiling than aftertreatment alone.

Two-Step Process Guidelines (Best Mode)

For the Continuous Applicaiton of Composition 1

| Concurrent (with dyestuffs) Portion: | |
|---|---|
| For Suessen H/S Substrates: | 2.0% owf |
| For Superba H/S Substrates: | 3.0% owf |
| For "High ICP" Substrates: | 4.0–5.0% owf |

Dyebath Make-up Procedure

1st—Wetting and leveling agent (defoamer, if required)

2nd—Composition and Epsom Salt ** ($MgSO_4—7H_2O$) (0.5% owf Epsom Salt for each 4.0% owf Composition 1)

3rd—0.25—0.50 g/l Sequestering agent (EDTA)

4th—Dyestuffs

5th—Adjust to desired pH with either acetic acid, ammonia or caustic soda*

Notes:

**Only phosphates which form water-soluble compleses with magnesium ion may be used in the presence of magnesium sulfate.

*Composition 1 has low pH. Use in the dyebath will result in pH's of 3.0—3.5, requiring an alkalai to adjust pH.

| Aftertreatment Portion: | |
|---|---|
| Composition 1 Concentration: | |
| For Suessen H/S Substrates: | 3.0% owf |
| For Superba H/S Substrates: | 5.0% owf |
| For "High ICP" Substrates: | 7.0–8.0% |

Application Parameters

Preheat/wash spray at 160° F. (71.1° C.) and extract (vacuum ) to 75–125% w.p.u. to give carpet temperature of 140° F. (60° C.).

Apply treatment solution at 180° F. (81.2° C.) and 400–50% w.p.u. to give a post-A/T carpet temperature of 160° F. (71.1° C.).

EXAMPLE 2

This is a further example of the continuous aftertreatment process of the invention, using Composition 2 in the treatment of the carpet fabric. The fabrics treated were (a) a fabric tufted from an 1186 denier continuous filament textured medium dye fiber in a Superba heatset (H/S) yarn to a 28-ounce cut pile fabric and (b) a textured 3.15/2 cotton count yarn from a 19 denier per filament staple deep dye fiber heat in a Suessen and tufted into 48-ounce fabric. Both were pretreated with the fluorocarbon of Example 1 and were to be dyed light gray. The nominal application conditions were 140° F. (60° C.) preheat water temperature, 180° F. (81.2° C.) application liquor temperature, 500 to 600% w.p.u. application liquor, the dyes and dyebath additives were as in Example 1, except no sequestrene was used. No Composition 2 or other s.a.c. was added to the dyebath. The following Tables show the application conditions and results.

TABLE VII

APPLICATION DATA

| Trial I.D. | Nominal Comp. 2 Applied, % | Target Nominal s.a.c. Level, % owf | Target Nominal Epsom Salts Level, % owf | Actual A/T Spray Header Pres., psig/ | A/T Liquor Deliv., GPM | Target A/T Liquor Conc., g/ |
|---|---|---|---|---|---|---|
| 1 | 0 | 0 | 0 | 6.2 | 73.3 | 0 |
| 2 | 15.0 | 2.8 | 0 | 6.2 | 73.3 | 25.0 |
| 3 | 0 | 0 | 0 | 6.5 | 75.2 | 0 |
| 4 | 9.0 | 1.7 | 0 | 6.5 | 75.2 | 17.2 |

| Trial I.D. | Calc. Conc. Comp. 2 Liquor g/l | Anal. Conc. Comp. 2 Liquor g/l | Calc. Comp. 2 Add-on from Set-up % owf | Calc. s.a.c. Add-on from Set-up % owf | Calc. s.a.c. Add-on from Anal. A/T Liquor % owf | Anal. s.a.c. Add-on from Carpets % owf | Calc. Epson Salt Add-on % owf |
|---|---|---|---|---|---|---|---|
| 1 | 0 | 0 | 0 | 0 | 0 | 0 | 0 |
| 2 | 30.4 | 21.2 | 17.7 | 3.4 | 2.3 | 2.62 | 0 |
| 3 | 0 | 0 | 0 | 0 | 0 | 0 | 0 |
| 4 | 20.9 | 14.4 | 10.9 | 2.1 | 1.5 | 1.89 | 0 |

Actual w.p.u. was between 523 and 532%, pH was 8.3 for control; 3.0 for Trial 2; 3.3 for Trial 4.

Preheat liquor temperature was 140° F. (60° C.). Carpet temperature was 127–130° F. (52.8–54.4° C.). Application liquor temperature was 179–182° F. (81.2–83.5° C.) and carpet temperature was 156–161° F. (68.9–71.7° C.).

TABLE VIII

STAINING PERFORMANCE, DURABILITY TO STEAM CLEANING AND CHANGE-OF-SHADE DATA

| Sample I.D. | Nominal Comp. 2 Applied, % | Stain Rating (0 = best, 10 = worst) Time Before Blotting with Water, Hr 0.05 | 0.5 | 1 | 4 |
|---|---|---|---|---|---|
| 1 | 0 | 8.5 | 8.5 | 8.5 | 8.5 |
| 2 | 15 | 0.25 | 0.25 | 0.75 | 1.5 |
| 3 | 0 | 4.5 | 7.0 | 7.0 | 7.0 |
| 4 | 9 | 0 | 0 | 0 | 0.1 |

| Sample I.D. | Stain Rating (0 = best, 10 = worst) Time Before Blotting with Water, Hr 8 | 24 | S.C.** 4 | Shade Change* |
|---|---|---|---|---|
| 1 | 8.5 | 8.5 | 7.0 | — |
| 2 | 1.75 | 2.0 | 5.0 | M-N (Y) |
| 3 | 7.0 | 7.0 | 7.0 | — |
| 4 | 0.1 | 0.1 | 3.0 | M (Y) |

*N = no, acceptable; M = marginal; Y = yellow.

Letter in parentheses indicates direction of color change from the control.

**steam cleaned.

TABLE IX

COLORFASTNESS DATA

| Sample I.D. | Nominal Comp. 2 Applied, % | Grey Scale Rating Lightfastness, AFU 20 | 40 |
|---|---|---|---|
| 1 | 0 | 4.0 | 3.0 |
| 2 | 15.0 | 2.5 | 3.0 |
| 3 | 0 | 4.5 | 3.5 |
| 4 | 9.0 | 3.5 | 3.5 |

Grey Scale Rating

TABLE IX-continued

| Sample I.D. | COLORFASTNESS DATA | | | | |
|---|---|---|---|---|---|
| | Ozonefastness | | | | $NO_2$* Fastness |
| | 1 | 2 | 3 | 5 | 1 cy |
| 1 | 3.0 | 2.5 | 2.0 | 1.0 | 2.5 |
| 2 | 3.0 | 2.5 | 2.5 | 2.0 | 1.0 |
| 3 | 3.5 | 3.0 | 2.5 | 2.0 | 2.5 |
| 4 | 3.5 | 3.0 | 3.0 | 2.5 | 1.5 |

*High R.H. nitrogen dioxide (AATCC TM-164).

TABLE X

| BENZOYL PEROXIDE SPOTTING DATA* | | | | | | |
|---|---|---|---|---|---|---|
| Sample I.D. | Nominal Comp. 2 Applied, % | Spot Visibility (0 = Invisible; 10 = Bright) Benzoyl Peroxide Conc., % Solution in Acetone | | | | |
| | | 0.01 | 0.05 | 0.10 | 1.0 | 5.0 |
| | | Originals | | | | |
| 1 | 0 | 2.0 | 7.5 | 8.0 | 9.0 | 9.5 |
| 2 | 15 | 1.0 | 6.5 | 7.0 | 8.5 | 8.5 |
| 3 | 0 | 2.0 | 7.5 | 8.0 | 9.0 | 9.5 |
| 4 | 9 | 2.0 | 7.5 | 8.0 | 8.5 | 8.5 |
| | | Steam Cleaned | | | | |
| 1 | | 1.0 | 5.0 | 7.0 | 9.0 | 9.5 |
| 2 | | 0.25 | 5.0 | 7.0 | 8.5 | 9.0 |
| 3 | | 0.5 | 5.0 | 7.0 | 8.5 | 9.0 |
| 4 | | 0.3 | 4.5 | 6.5 | 8.0 | 9.0 |

*Sample spotted with 1 ml of benzoyl peroxide solution and exposed in chamber at 90° F. (32.2° C.) and 80% R.H. for three days (color change ceases).

TABLE XI

| REPELLENCY DATA (FINISHED CARPETS) | | | |
|---|---|---|---|
| Sample I.D. | Nominal Comp. 2 Applied, % | Repellency | |
| | | Oil | Water |
| 1 | 0 | 4.0 | 4.0 |
| 2 | 15.0 | 4.0 | 4.5 |
| 3 | 0 | 3.0 | 4.0 |
| 4 | 9.0 | 3.0 | 4.5 |

This Example 2 demonstrates the effectiveness of the sulfonated aromatic condensate with only a dispersing agent and further demonstrates the effectiveness of the continuous aftertreatment process of this invention.

EXAMPLE 3

PART 1

This example demonstrates the effective use of the process of this invention on fabric which has not been previously treated with any fluorocarbon compound for antisoiling properties. The Composition 2 used in the continuous aftertreatment process (no two step) of this invention as set forth in Example 1. Dyebath formulation was as in Example 2. Conditions were as in Example 1, more specifically, preheat water temperature was 195° F. (90.6° C.) at 100% w.p.u. to achieve carpet temperature of 135°-140° F. (57.2° to 60° C.). Aftertreatment liquor temperature was 180°-185° F. (82.2° to 85° C.) to achieve carpet temperature of 160°-170° F. (71.1° to 76.7° C.) Aftertreatment dwell time was 30 seconds before washing at 40:1 liquor to fabric ratio, hydroextraction and drying. Both compositions were applied to both 1.5 and 3.0% on the weight of the fabric. Samples of fabric pretreated with fluorocarbons, which are also part of the invention, were run alongside the fabric untreated with fluorocarbon. The results show that higher amounts of sulfonated aromatic condensate must be applied to the fabric untreated with fluorocarbon to achieve the nearly same level of strain resistance. The following tables give application conditions and results.

TABLE XII

| EVALUATION OF STAIN BLOCKING FOR CONTINUOUS AFTERTREATMENT | | | | | |
|---|---|---|---|---|---|
| Sample I.D. | Nominal Add-on, %* | Fabric With Fluoro. | Fabric Without Fluoro. | Fabric With Fluoro. | Fabric Without Fluoro. |
| | | Stain Rating Total[1] | | 20 AFU Rank[2] | |
| 1 | 0 | 54.0 | 45.0 | 2 | 3 |
| 2 | 3.0 | 1.5 | 1.4 | 4 | 7 |
| 3 | 3.0 | 0.3 | 0.3 | 4 | 9 |
| 4 | 3.0 | 1.2 | 1.5 | 4 | 9 |

*Samples 2 and 4 applied at pH 3. Samples 1 and 3 were applied at pH 2.
[1]Total of ratings at 1, 4, 7 and 24-hour tests. High numbers indicate most stain.
[2]Lower numbers are better.

| | $NO_2$ Rank[2] | | Soiling Rating** | |
|---|---|---|---|---|
| 1 | 1 | 1 | 4 | 8 |
| 2 | 2 | 2 | 9.5 | 9 |
| 3 | 2 | 3 | 10 | 10 |
| 4 | 2 | 2 | 5.5 | 7.5 |

**Soiling evaluated under Accelerated Method, 0 = best, 10 = worst.
[2]Lower numbers are better.

TABLE XIII

| ANALYSIS DATA | | | |
|---|---|---|---|
| Sample I.D. | Nominal Add-on, % | S.a.c. Analyzed, % owf* | |
| | | Fabric With Fluoro. | Fabric Without Fluror. |
| 1 | — | 0 | 0 |
| 2 | 3.0 | 3.09 | 2.96 |
| 3 | 3.0 | 3.47 | 3.36 |
| 4 | 3.0 | 2.94 | 2.86 |

Samples 2 and 4 were applied at pH 3. Samples 1 and 3 were applied at pH 2.
*Extracted from carpets with 0.1 N NaOH for four hours and analyzed by HPLC against original material.

EXAMPLE 3

Part 2

The condition of Example 3 - Part 1 were repeated except Composition 1 was used with the results shown in the following tables. All fabric was without fluorocarbon treatments.

TABLE XIV

| STAINING AND CHANGE-OF-SHADE DATA | | | | | | |
|---|---|---|---|---|---|---|
| Trial I.D. | Nominal Comp. 1 Add-on, % owf | Stain Rating (0 = best, 10 = worst) Time Before Blotting With Water, Hr | | | | Shade Change |
| | | 1 | 4 | 7 | 24 | |
| 1 | — | 7.0 | 7.0 | 7.0 | 7.0 | — |
| 2 | 5.0 | 0.25 | 1.0 | 1.0 | 0.75 | M (Y) |
| 3 | 6.0 | 0.1 | 0.75 | 0.75 | 0.5 | M (Y) |
| 4 | 7.0 | 0.1 | 0.25 | 0.25 | 0.25 | M (Y) |
| 5 | 8.0 | 0.1 | 0.25 | 0.25 | 0.25 | M (Y) |

TABLE XV

| COLORFASTNESS DATA | | | | | | |
|---|---|---|---|---|---|---|
| Trial I.D. | Nominal Comp. 1 Add-on, % owf | Grey Scale Rating | | | | |
| | | Lightfastness, AFU | | Ozonefastness, cy | | $NO_2$* Fastness, cy |
| | | 20 | 40 | 1 | 3 | 1 |
| 1 | — | 4.0 | 3.5 | 3.5 | 2.0 | 3.0 |
| 2 | 5.0 | 4.5 | 4.0 | 4.0 | 3.0 | 2.5 |
| 3 | 6.0 | 4.5 | 4.0 | 4.0 | 3.5 | 2.5 |
| 4 | 7.0 | 4.5 | 4.0 | 4.0 | 3.5 | 2.5 |

TABLE XV-continued

| Trial I.D. | Nominal Comp. 1 Add-on, % owf | COLORFASTNESS DATA Grey Scale Rating Lightfastness, AFU 20 | 40 | Ozonefastness, cy 1 | 3 | $NO_2$* Fastness, cy 1 |
|---|---|---|---|---|---|---|
| 5 | 8.0 | 4.5 | 4.0 | 4.5 | 4.0 | 2.5 |

TABLE XVI

ANALYSIS DATA

| Trial I.D. | Nominal Comp. 1 Add-on, % owf | Nominal Comp. 1 Conc. A/T Liquor g/l* | Anal. A/T Liquor Conc. of sac g/l | s.a.c. Add-on Based on Anal. A/T Liquor % owf | Anal. sac Add-on from Carpets % owf | Anal. sac in Rinse Bath g/l |
|---|---|---|---|---|---|---|
| 1 | — | — | — | — | N/D** | N/D |
| 2 | 5.0 | 12.5 | 11.8 | 4.7 | 5.1 | N/D |
| 3 | 6.0 | 15.0 | 15.0 | 6.0 | 7.3 | N/D |
| 4 | 7.0 | 17.5 | 19.6 | 7.8 | 7.5 | N/D |
| 5 | 8.0 | 20.0 | 23.5 | 9.4 | 8.3 | N/D |

*Applied at 400% w.p.u.
**Non-detected

EXAMPLE 4

The process and conditions of dyeing formulations of Example 2 using Composition 2 were repeated with and without citric acid to adjust pH in the continuous after-treatment application process of this invention the fabric was in 32 ounce per square yard cut pile construction of a 1185 denier bulked continuous filament, Superba H/S, beck-dyed grey. The fiber had been treated with fluorocarbon for antisoiling properties. Also all dispersing agents (Tamol) were omitted from Composition 2 for another set of samples. Epsom salt (49% $MgSO_4$) was added to another set of samples. Citric acid was used as a rinse and in the application liquor. Use of citric acid in the treatment liquor or to adjust pH resulted in improved yellowing of the sulfonated aromatic condensate treated fiber. The combination of Epsom salt and citric acid further reduced the tendency to yellow whether due to exposure to ozone or to $NO_2$. The following tables provide application conditions and results.

TABLE XVII

EVALUATION OF CITRIC ACID - USE FOR CONCENTRATE pH ADJUSTMENT ON LIGHT INDUCED YELLOWING APPLICATION AND ANALYSIS DATA

| Sample I.D. | s.a.c. Used | Nominal s.a.c. Applied, % | Other Agents/Conc. |
|---|---|---|---|
| 6 | Not Treated | 0 | — |
| 1 | Compostition 2 | 3.0 | — |
| 2 | Compostition 2 | 3.0 | — |
| 3 | Compostition 2 | 3.0 | — |
| 4 | Compostition 2 | 3.0 | — |
| 5 | Compostition 2 | 3.0 | — |
| 7 | Compostition 2 | 3.0 | 0.09 g/l Citric Acid |
| 8 | Compostition 2 | 3.0 | 0.09 g/l Citric Acid |
| 9 | Compostition 2 | 3.0 | 0.75 g/l Citric Acid |
| 10 | Compostition 2 | 3.0 | 0.75 g/l Citric Acid |
| 11 | Intratex N | 3.0 | Citric Acid (pH adj)* |
| 12 | Intratex N | 3.0 | Citric Acid (pH adj)* |
| 13 | Intratex N | 3.0 | 0.72% owf Epsom Salt & Citric Acid (pH adj)* |
| 14 | Intratex N | 3.0 | 0.72% owf Epsom Salt & |

TABLE XVII-continued

EVALUATION OF CITRIC ACID - USE FOR CONCENTRATE pH ADJUSTMENT ON LIGHT INDUCED YELLOWING APPLICATION AND ANALYSIS DATA

| Sample I.D. | Appl. pH | Citric Acid (pH adj)* Rinse | s.a.c. Analyzed % |
|---|---|---|---|
| 6 | 7.5 | Normal - Cold Water | 0 |
| 1 | 3.1 | Normal - Cold Water | 1.87 |
| 2 | 3.1 | 0.09 g/l Citric (pH 4.1) | 2.18 |
| 3 | 3.1 | 0.25 g/l Citric (pH 3.5) | 2.29 |
| 4 | 3.1 | 0.75 g/l Citric (pH 3.1) | 2.32 |
| 5 | 3.1 | 5.9 g/l Citric (pH 2.5) | 2.44 |
| 7 | 3.1 | Normal - Cold Water | 1.90 |
| 8 | 3.1 | No Rinse | 2.10 |
| 9 | 2.9 | Normal - Cold Water | 2.04 |
| 10 | 2.9 | No Rinse | 2.30 |
| 11 | 3.0 | Normal - Cold Water | 2.67 |
| 12 | 3.0 | No Rinse | 2.39 |
| 13 | 3.0 | Normal - Cold Water | 2.89 |
| 14 | 3.0 | No Rinse | 2.89 |

Notes:
*1.25 g/l citric acid required for pH adjustment.
Carpet temperature before A/T ranged from 132 to 138° F. (55.6–58.9° C.).
A/T liquor temperature was 183 to 185° F. (83.9–85° C.).
Actual temperature after A/T ranged from 163 to 171° F. (72.8–77.2° C.)

TABLE XVIII

EVALUATION OF CITRIC ACID - USE FOR CONCENTRATE pH ADJUSTMENT ON LIGHT INDUCED YELLOWING STAINING PERFORMANCE AND CHANGE-OF-SHADE DATA

| Sample I.D. | Stain Rating (0 = best, 10 = worst) Time Before Blotting With Water, Hr 0.05 | 0.5 | 1 | 4 | 8 | 24 | Shade Change* |
|---|---|---|---|---|---|---|---|
| 6 | 9.5 | 9.5 | 9.5 | 9.5 | 9.5 | 9.5 | — |
| 1 | 0 | 0.25 | 0.5 | 1.0 | 1.0 | 1.0 | M-N |
| 2 | 0 | 0.25 | 0.25 | 0.5 | 0.5 | 0.75 | M-N |
| 3 | 0 | 0.25 | 0.25 | 0.5 | 0.75 | 1.0 | M-N |
| 4 | 0 | 0.25 | 0.25 | 0.5 | 0.75 | 0.75 | M-N |
| 5 | 0 | 0.25 | 0.5 | 0.5 | 1.0 | 1.5 | M-N |
| 7 | 0 | 0.25 | 0.25 | 0.25 | 0.25 | 0.25 | M-N(Y) |
| 8 | 0 | 0.25 | 0.25 | 0.5 | 1.0 | 1.0 | M-N(B) |
| 9 | 0 | 0.25 | 0.25 | 0.25 | 0.5 | 0.75 | M-N(B) |
| 10 | 0 | 0.1 | 0.1 | 0.5 | 0.5 | 0.5 | M-N |
| 11 | 0.1 | 0.5 | 0.5 | 0.5 | 0.5 | 1.0 | M-N |
| 12 | 0 | 0.25 | 1.0 | 2.0 | 2.5 | 2.5 | M-N |
| 13 | 0 | 0.25 | 0.25 | 0.25 | 0.25 | 0.25 | M-N(B) |
| 14 | 0 | 0.25 | 0.5 | 0.5 | 0.5 | 0.5 | M-N(B) |

*M = marginal, N = none, Y = yellow, B = blue

TABLE XIX

EVALUATION OF CITRIC ACID - USE FOR CONCENTRATE pH ADJUSTMENT ON LIGHT INDUCED YELLOWING COLORFASTNESS DATA

| Sample I.D. | Grey Scale Rating Lightfastness, AFU 20 | 40 | Ozonefastness, cy 1 | 2 | 3 | 5 | $NO_2$* Fastness, 1 cy |
|---|---|---|---|---|---|---|---|
| 6 | 4.0 | 3.5 | 3.0 | 2.5 | 1.5 | 1.0 | 2.5 |
| 1 | 2.5 | 3.0 | 3.0 | 2.5 | 2.5 | 2.0 | 1.5 |
| 2 | 2.5 | 3.0 | 3.0 | 2.5 | — | — | 1.5 |
| 3 | 2.5 | 3.0 | 3.0 | 2.5 | — | — | 1.5 |
| 4 | 3.0 | 3.0 | 3.5 | 3.0 | 3.0 | 2.5 | 1.5 |
| 5 | 3.0 | 3.0 | 3.5 | 3.0 | — | — | 2.0 |
| 7 | 2.5 | 3.0 | 3.0 | 3.0 | — | — | 1.5 |
| 8 | 2.5 | 3.0 | 3.0 | 3.0 | — | — | 1.5 |
| 9 | 3.0 | 3.0 | 3.5 | 3.0 | 3.0 | 2.5 | 2.0 |
| 10 | 2.5 | 3.0 | 3.5 | 3.0 | 3.0 | 2.5 | 1.5 |
| 11 | 3.0 | 3.5 | 3.5 | 3.0 | — | — | 2.0 |
| 12 | 3.0 | 3.5 | 3.5 | 3.0 | — | — | 2.0 |
| 13 | 4.0 | 3.5 | 3.5 | 3.0 | 3.0 | 3.0 | 2.5 |

TABLE XIX-continued

EVALUATION OF CITRIC ACID - USE FOR CONCENTRATE pH ADJUSTMENT ON LIGHT INDUCED YELLOWING COLORFASTNESS DATA

| Sample | Grey Scale Rating | | | | | | |
|---|---|---|---|---|---|---|---|
| | Lightfastness, AFU | | Ozonefastness, cy | | | | $NO_2$* Fastness, |
| I.D. | 20 | 40 | 1 | 2 | 3 | 5 | 1 cy |
| 14 | 4.0 | 3.5 | 3.5 | 3.5 | 3.5 | 3.0 | 2.5 |

*High R.H nitrogen dioxide (AATCC TM-164).

TABLE XX

EVALUATION OF CITRIC ACID - USE FOR CONCENTRATE pH ADJUSTMENT ON LIGHT INDUCED YELLOWING BENZOYL PEROXIDE SPOTTING DATA*

| Sample | Spot Visibility (0 = Invisible; 10 = Bright) Benzoyl Peroxide Conc., % Soln. in Acetone | | | | |
|---|---|---|---|---|---|
| I.D. | 0.01 | 0.05 | 0.10 | 1.0 | 5.0 |
| 6 | 3.0 | 7.0 | 8.0 | 9.0 | 9.5 |
| 1 | 0.75 | 5.5 | 6.5 | 7.5 | 8.0 |
| 13 | 0 | 0.25 | 0.5 | 1.5 | 2.5 |
| 14 | 0 | 0.25 | 0.5 | 1.5 | 2.5 |

*Sample spotted with 1 ml of benzoyl peroxide solution and exposed in chamber at 90° F. (32.2° C.) and 80% R.H. for three days.

EXAMPLE 5

The process on the fabric of Example 4 was repeated, also using Composition 2 with and without the Tamol dispersant, and also adding NH4SCN to show its benefits.

Following are the standard continuous process aftertreatment conditions used:

Prewet/heat carpet at 195° F. (90.6° C.) and 100% w.p.u. to achieve a carpet temperature prior to treatment of 135° to 140° F. (57.2° to 60° C.).

Apply A/T liquor at 400% w.p.u. and 175° to 180° F. (79.4° to 82.2° C.) to achieve a post-A/T carpet temperature of 160° to 170° F. (71.1° to 76.7° C.).

Aftertreatment, 30-second dwell time before washing (at 40:1 liquor ratio), hydroextraction and drying.

Summary of Results

1. Application

The addition of $NH_4SCN$ to the Composition 2 bath was found to affect pH only at the lowest concentration. This is an indication of the buffering capacity of Composition 2 solutions.

During the make-up and running of the treatment solutions, it was observed that considerably more foaming occurs with Intratex-N alone than does Composition 2.

2. Stain Resistance

Composition 2 tended to exhibit better staining performance than Intratex N alone at comparable levels. The differences between the two diminish as the overall concentration increases.

The addition of $NH_4SCN$ did not adversely affect the staining performance and, in fact, samples with $NH_4SCN$ tended to perform better than corresponding samples without $NH_4SCN$. This difference diminishes as the Intratex N concentration increases and overall performance improves.

3. Light and $NO_2$ Induced Yellowing (Table XXIII)

Intratex N and Tamol SN (by themselves) were found to behave differently when exposed to light. Intratex N yellows/browns severely at short light exposures (20 afu). This yellowing or browning then fades as the lightfastness exposure is continued. Tamol, on the other hand, greens when exposed to 20 afu and upon continued exposure the green fades to yellow. The overall rating of the shade change does not necessarily improve from the 20 to 40 afu exposures. The severity of shade change is about equal for Intratex N and Tamol SN.

The break of Composition 2 at short lightfastness exposures (20 afu) appears as a hybrid of Intratex N and Tamol SN alone (at the respective levels in Composition 2).

At both 20 and 40 afu, the break of Composition 2 samples were no worse-to-slightly better than the corresponding Intratex N and Tamol SN only samples.

The addition of $NH_4SCN$ gives a slight improvement in light induced yellowing. The reduction is greatest at the lower Intratex N levels and decreases as the Intratex N level increases. Similar behavior is observed between Composition 2 and Intratex N alone, but Tamol SN is less affected.

Yellowing diminishes as the $NH_4SCN$ level increases. The yellowing is significantly reduced using approximately 0.3% owf $NH_4SCN$ for every 1.0% owf Intratex N.

Tamol SN was found to be unaffected by exposure to $NO_2$, while Composition 2 and Intratex N yellowed severely. The addition of $NH_4SCN$ improved $NO_2$ yellowing only slightly, but not enough to raise Grey Scale ratings above 1-2.

4. Ozonefastness (Table XXIII)

Intratex N had a significant impact on ozonefastness, both alone and as Composition 2. While overall fastness ratings tended to be better at extended cycles compared to the nontreated control, a significant yellowing occurs.

The yellowing of Intratex N overwhelms any improvement achieved by the addition of $NH_4SCN$. Samples incorporating $NH_4SCN$ tend to yellow less when exposed to ozone and higher levels yield more improvement. The significant improvement in ozonefastness of $NH_4SCN$ alone was not achieved, but were improved over nontreated samples

5. Benzoyl Peroxide Spotting (Table XXIV)

The dispersant, Tamol SN, had no effect on the benzoyl peroxide spotting performance. Table XXIV shows the benzoyl peroxide performance identical when 0.3% owf $NH_4SCN$ is applied with either Composition 2 or s.a.c. at several levels.

The performance of $NH_4SCN$ is not effected at varied s.a.c. levels (as Composition 2 or alone) as shown in Table XXIV.

Benzoyl peroxide spotting improves as the $NH_4SCN$ concentration is increased from 0.3 to 0.6% owf. The improvement becomes more noticeable at the highest benzoyl peroxide concentration and probably beyond.

Conclusions

The dispersant, Tamol SN, contributes to the light induced yellowing of Composition 2 but is not the sole cause. Elimination of Tamol SN from Composition 2 would not significantly improve or resolve yellowing on Superba H/S substrates. The elimination of Tamol SN could reduce staining performance slightly at lower add-on's and increase the foaming of the treatment liquor upon spray application.

Intratex N is the sole cause of yellowing upon exposure to $NO_2$ of Composition 2.

Tamol does not interfere with any of the $NH_4SCN$ benefits.

Intratex N has a significant impact on ozonefastness (yellows) and overwhelms the ozonefastness improvement benefits of $NH_4SCN$. There is, however, a reduction in the yellowing and an improvement over Composition 2 alone at a nominal 0.6% owf $NH_4SCN$.

$NH_4SCN$ has no adverse impacts on Composition 2 stain blocking benefits.

There is a reduction in light induced yellowing when $NH_4SCN$ is applied with Composition 2. The degree of improvement has varied from marginal to significant during all internal trials. Higher $NH_4SCN$ levels always yield greater improvement.

Benzoyl peroxide spotting performance may be further improved, particularly at higher benzoyl peroxide concentrations, by increasing the NH4SCN level to 0.6% owf.

TABLE XXI

APPLICATION AND ANALYSIS DATA

| Sample I.D. | Nominal s.a.c. Applied as Comp. 2, % | Nominal s.a.c. Applied* % | Nominal Tamol SN Applied* % | Nominal $NH_4SCN$ Applied % | pH | s.a.c. Anal. (As Rec'd) % |
|---|---|---|---|---|---|---|
| 1 | — | — | — | — | 7.4 | 0 |
| 28 | — | — | — | 0.3 | 2.8 | 0 |
| 2 | 1.0 | — | — | — | 3.5 | 1.05 |
| 3 | 1.0 | — | — | 0.3 | 4.6 | 1.08 |
| 4 | 1.0 | — | — | 0.6 | 4.7 | 1.05 |
| 5 | 2.0 | — | — | — | 3.1 | 1.91 |
| 6 | 2.0 | — | — | 0.3 | 3.2 | 1.93 |
| 7 | 2.0 | — | — | 0.6 | 3.2 | 2.16 |
| 8 | 3.0 | — | — | — | 3.0 | 3.19 |
| 9 | 3.0 | — | — | 0.3 | 3.0 | 3.58 |
| 10 | 3.0 | — | — | 0.6 | 3.0 | 3.24 |
| 11 | 4.0 | — | — | — | 2.8 | 3.23 |
| 12 | 4.0 | — | — | 0.3 | 2.9 | 4.20 |
| 13 | 4.0 | — | — | 0.6 | 2.9 | 3.90 |
| 14 | — | 2.0 | — | — | 3.2 | 2.10 |
| 15 | — | 2.0 | — | 0.3 | 3.2 | 2.43 |
| 16 | — | 3.0 | — | — | 2.9 | 3.83 |
| 17 | — | 3.0 | — | 0.3 | 2.8 | 4.20 |
| 18 | — | 4.0 | — | — | 2.7 | 4.97 |
| 19 | — | 4.0 | — | 0.3 | 2.7 | 4.73 |
| 20 | — | — | 1.93 | — | 2.9 | — |
| 21 | — | — | 1.93 | 0.3 | 2.9 | — |
| 22 | — | — | 2.90 | — | 2.8 | — |
| 23 | — | — | 2.90 | 0.3 | 2.8 | — |
| 24 | — | — | 3.89 | — | 2.8 | — |
| 25 | — | — | 3.89 | 0.3 | 2.9 | — |

*Materials applied as supplied, not blended or part of a composition.

Notes:

Carpet temperature before A/T ranged from 132 to 144° F. (55.6–62.2° C.).

A/T liquor temperature was 178 to 183° F. (55.6–62.2° C.).

Actural temperature after A/T ranged from 158 to 172° F. (70–77.8° C.)

TABLE XXII

STAINING PERFORMANCE DATA

| Sample I.D. | Stain Rating (0 = best, 10 = worst) Time Before Blotting With Water, Hours 0.05 | 0.5 | 1 | 4 | 8 | 24 |
|---|---|---|---|---|---|---|
| 1 | 9.5 | 9.5 | 9.5 | 9.5 | 9.5 | 9.5 |
| 2 | 0 | 1.0 | 2.0 | 3.5 | 3.5 | 3.5 |
| 3 | 0 | 1.0 | 1.5 | 2.0 | 3.0 | 3.0 |
| 4 | 0 | 0.5 | 0.75 | 1.5 | 1.0 | 1.0 |

TABLE XXII-continued

STAINING PERFORMANCE DATA

| Sample I.D. | Stain Rating (0 = best, 10 = worst) Time Before Blotting With Water, Hours 0.05 | 0.5 | 1 | 4 | 8 | 24 |
|---|---|---|---|---|---|---|
| 5 | 0 | 0.25 | 0.5 | 1.0 | 1.0 | 1.5 |
| 6 | 0 | 0.25 | 0.25 | 1.0 | 1.0 | 1.0 |
| 7 | 0 | 0 | 0.25 | 0.5 | 0.5 | 0.5 |
| 8 | 0 | 0.25 | 0.25 | 0.75 | 0.75 | 0.75 |
| 9 | 0 | 0 | 0.10 | 0.25 | 0.25 | 0.25 |
| 10 | 0 | 0 | 0 | 0.25 | 0.5 | 0.5 |
| 11 | 0 | 0 | 0.1 | 0.5 | 0.25 | 0.5 |
| 12 | 0 | 0 | 0.1 | 0.25 | 0.25 | 0.5 |
| 13 | 0 | 0 | 0 | 0.25 | 0.25 | 0.25 |
| 14 | 0 | 0.5 | 1.0 | 1.5 | 2.0 | 3.0 |
| 15 | 0 | 0.5 | 1.0 | 1.25 | 2.0 | 2.5 |
| 16 | 0 | 0.25 | 0.25 | 0.5 | 0.5 | 0.5 |
| 17 | 0 | 0 | 0.25 | 0.5 | 0.25 | 0.25 |
| 18 | 0 | 0.1 | 0.1 | 0.25 | 0.25 | 0.25 |
| 19 | 0 | 0 | 0 | 0.25 | 0.1 | 0.1 |

TABLE XXIII

COLORFASTNESS DATA

| Sample I.D. | Grey Scale Rating: Lightfastness, AFU 20 | 40 | Ozonefastness, cy 1 | 2 | 3 | 5 | $NO_2$* Fastness, 1 cy |
|---|---|---|---|---|---|---|---|
| 1 | 4.0 | 3.0 | 3.0 | 2.5 | 2.0 | 1.0 | 3.0 |
| 28 | 4.0 | 3.0 | 3.5 | 3.0 | 3.0 | 3.0 | 3.0 |
| 2 | 2.5 | 3.0 | 3.0 | 2.5 | 2.5 | 2.0 | 1.5 |
| 3 | 3.0 | 3.5 | 3.0 | 2.5 | 2.5 | 2.5 | 1.5 |
| 4 | 3.5 | 3.5 | 3.0 | 2.5 | 2.5 | 2.5 | 1.5 |
| 5 | 2.5 | 2.5 | 2.5 | 2.5 | 2.0 | 2.0 | 1.5 |
| 6 | 2.5 | 2.5 | 3.0 | 2.5 | 2.5 | 2.0 | 1.5 |
| 7 | 3.0 | 3.0 | 3.0 | 2.5 | 2.5 | 2.5 | 1.5 |
| 8 | 2.0 | 2.5 | 2.5 | 2.5 | 2.0 | 2.0 | 1.5 |
| 9 | 2.0 | 2.5 | 2.5 | 2.5 | 2.5 | 2.0 | 1.5 |
| 10 | 2.5 | 2.5 | 3.0 | 3.0 | 2.5 | 2.5 | 1.5 |
| 11 | 2.0 | 2.0 | 2.5 | 2.5 | 2.0 | 2.0 | 1.5 |
| 12 | 2.0 | 2.0 | 2.5 | 2.5 | 2.0 | 2.0 | 1.5 |
| 13 | 2.5 | 2.5 | 3.0 | 3.0 | 2.5 | 2.5 | 1.5 |
| 14 | 2.5 | 2.5 | 2.5 | 2.5 | 2.0 | 2.0 | 1.5 |
| 15 | 3.0 | 2.5 | 2.5 | 2.5 | 2.0 | 2.0 | 1.5 |
| 16 | 2.0 | 2.0 | 2.5 | 2.5 | 2.0 | 2.0 | 1.5 |
| 17 | 2.5 | 2.5 | 2.5 | 2.5 | 2.5 | 2.0 | 1.5 |
| 18 | 2.0 | 2.0 | 2.0 | 2.0 | 2.0 | 2.0 | 1.5 |
| 19 | 2.5 | 2.0 | 2.5 | 2.5 | 2.0 | 2.0 | 2.0 |
| 20 | 2.5 | 2.5 | 2.5 | 2.5 | — | — | 2.5 |
| 21 | 2.5 | 2.5 | 3.0 | 3.0 | — | — | 3.0 |
| 22 | 2.0 | 2.0 | 3.0 | 2.5 | — | — | 3.0 |
| 23 | 2.0 | 2.0 | 3.0 | 2.5 | — | — | 3.0 |
| 24 | 2.0 | 2.0 | 3.0 | 2.5 | — | — | 2.5 |
| 25 | 2.0 | 2.0 | 3.0 | 2.5 | — | — | 3.0 |

*High R.H nitrogen dioxide (AATCC TM-164).

TABLE XXIV

BENZOYL PEROXIDE SPOTTING DATA*

| Sample I.D. | Spot Visibility (0 = Invisible; 10 = Bright) Benzoyl Peroxide Conc., % Soln. in Acetone 0.005 | 0.01 | 0.05 | 0.1 | 1.0 |
|---|---|---|---|---|---|
| 1 | 0.5 | 1.5 | 6.5 | 8.0 | 9.0 |
| 28 | 0 | 0 | 0.75 | 1.0 | 8.0 |
| 2 | 0.25 | 2.0 | 6.75 | 8.0 | 8.5 |
| 3 | 0 | 0 | 1.25 | 4.0 | 7.0 |
| 4 | 0 | 0 | 0.25 | 0.5 | 2.0 |
| 5 | 0.5 | 1.75 | 5.5 | 6.5 | 7.5 |
| 6 | 0 | 0 | 0.5 | 1.0 | 2.0 |
| 7 | 0 | 0 | 0.1 | 0.75 | 3.0 |
| 8 | 0.25 | 2.0 | 7.25 | 7.5 | 7.5 |
| 9 | 0 | 0 | 0.5 | 1.25 | 2.0 |
| 10 | 0 | 0 | 0.25 | 0.5 | 0.75 |
| 11 | 1.0 | 2.5 | 7.5 | 8.0 | 8.5 |
| 12 | 0 | 0 | 0.5 | 1.0 | 3.0 |
| 13 | 0 | 0 | 0.1 | 0.5 | 1.25 |
| 14 | 0.5 | 1.5 | 6.5 | 7.5 | 8.0 |
| 15 | 0 | 0 | 0.5 | 1.0 | 2.0 |

TABLE XXIV-continued

| BENZOYL PEROXIDE SPOTTING DATA* | | | | | |
|---|---|---|---|---|---|
| Sample | Spot Visibility (0 = Invisible; 10 = Bright) Benxoyl Peroxide Conc., % Soln. in Acetone | | | | |
| I.D. | 0.005 | 0.01 | 0.05 | 0.1 | 1.0 |
| 16 | — | — | — | — | — |
| 17 | — | — | — | — | — |
| 18 | 0.25 | 1.0 | 6.5 | 7.5 | 8.5 |
| 19 | 0 | 0 | 0.5 | 0.75 | 1.75 |

*Sample spotted with 1 ml of benzoyl peroxide solution and exposed in chamber at 90° F. (32.2° C.) and 80% R.H. for three days.

EXAMPLE 6

This example demonstrates the two-step, batch-batch (beck-beck) process embodiment of this invention.

Prior art has shown that application of sulfonated aromatic condensates (stain blockers) to nylon improves resistance to staining by most food colors. In the prior art, the preferred mode of application has been a low temperature (120° to 180° F. (48.9° to 82.2° C.) treatment with the stain blocker after dyeing has been completed. Also, prior art includes application of stain blockers concurrent with dye application. This invention embodies application of a portion of the total stain blocker concurrently with dye application, and application of the remainder in a low temperature aftertreatment step. (two-step process).

The two-step process results in a level of stain performance superior to that which is achieved by the prior art at the same total add-on concentration of stain blocker. In addition, use of ammonium thiocyanate in the aftertreatment step improves dye fastness to ozone, benzoyl peroxide (acne medications) and light. It is theorized that the improvement over prior art is achieved by maximization of the concentration of stain blocker in a thin zone near the fiber surface and that this condition results in better stain resistance. The two-step process promotes this condition by sorption of a portion of the stain blocker during the dyeing operation which is fully penetrated into the cross-section of the nylon fiber. The sorption of the portion of stain blocker subsequently applied in the low temperature aftertreatment step in retarded by the presence of the existing portion already on the fiber, therefore, increasing the effective concentration near the fiber surface. The presence of magnesium sulfate in both steps of the process accelerates rate of sorption of the stain blocker by increasing the bath electrolyte concentration and by complexing with the stain blockers thus reducing molecular mobility in the nylon.

Example 6—Part 1

This example shows that two-step process is superior to either concurrent or aftertreatment.

Carpet Fabric 1185 denier fluorocarbon treated Superba Heat Set

Process

A total of 2.0% owf Intratex N was applied to carpet. The total was distributed between dyebath and aftertreatment in the following ways:

| Dyebath, % | Aftertreatment, % |
|---|---|
| 0 | 100 |
| 50 | 50 |
| 100 | 0 |

Varying amounts of Magnesium Sulfate were used (0% owf to 4% owf).

Dyebath conditions were typical of industry practice.

Dyeing procedure as follows:

1. Load fabric and wet out at 20:1 Liquor Ratio
2. Add 1.0% owf Dowfax 2Al-sodium mono-and didodecyl disulfonated diphenyl oxide (45% active)
3. Add the specified amount of Intratex N-1
4. Add the specified amount of Magnesium Sulfate
5. Run 5 minutes
6. Add 0.5% Sequestrene 30A (EDTA) or equiv.
7. Add 1% owf ammonium sulfate
8. Add 0.5% owf ammonium hydroxide
9. Add predissolved dyes
10. Run 10 minutes
11. Raise temperature to boil
12. Boil 30 minutes
13. Drop and rinse cold
14. Aftertreat if indicated Aftertreatment procedure as follows:

1. Refill Beck at 20:1 Liquor Ratio
2. Add specified amount of Magnesium Sulfate
3. Add specified amount of Intratex Nl
4. Run 10 minutes
5. Lower pH to 2.0 to 2.1 with sulfamic acid
6. Raise temperature to 160° F. (71.1° C.).
7. Hold at temperature 20 minutes
8. Drop bath and rinse cold

Performance

Reference samples Nos. 17 through 31 in Table XXV. Samples 23, 24 and 25 prepared with the 50%/50% two-step process are superior. Those samples which passed the dip test were further tested by the drop test.

Test Protocols

1. "Dip Test"—Immerse a 5 gram sample of unfinished carpet into a large excess of Cherry Kool-Aid (unsweetened) at room temperature for 30 minutes. Rinse with cold water, dry and assess the stain.
2. "Drop Test"—Drop 30 ml. Cherry Kool-Aidl (unsweetened) onto the finished carpet from a height of 12 inches. Allow to stand for seven hours. Blot with paper towels using water spray to aid in removal.

[1] Registered TM of General Foods Corporation.

Example 6—Part 2

This example shows use of ammonium thiocyanate in two-step process for improved resistance to benzoyl peroxide and light fading.

Carpet Fabric 1700 denier Superba Heat Set (High ICP fiber)

Process

Using the process of Part 1, a total of 2.8% Intratex N was applied using the 50%/50% two-step mode. A second sample was prepared in the same way but an Intratex N pre-formulated mixture containing ammonium thiocyanate (Composition 3) was used in the aftertreatment step. Composition 3 is 40% Intratex N-1, 12% ammonium thiocyanate, 21.5% Monawet MB45, 26.5% Water.

Performance

Reference samples "H" and "I" in Tables XXVI to XXVIII. Using the "Drop Test" Protocol from Example 1, sample "I" has good stain resistance (somewhat poorer than "H") but very significant improvements in benzoyl peroxide and light fading.

Example 6—Part 3

This example shows that 50%/50% two-step mode is preferred and the 2% magnesium sulfate is optimum.

Carpet Fabric 1185 denier fluorocarbon treated autoclave Heat Set (high ICP fiber)

Process

Using the process of Part 1, a total of 3.0% Intratex N-1 was applied using the two-step mode.

The total was distributed between dyebath and aftertreatment in the following ways:

| Dyebath, % | Aftertreatment, % |
|---|---|
| 0 | 100 |
| 5 | 95 |
| 10 | 90 |
| 20 | 80 |
| 30 | 70 |
| 50 | 50 |

Varying amount of magnesium sulfate were used (0% owf to 4% owf)

Performance

Reference samples 2 through 23 Table XXIX. Using the test protocols from Example 1, samples 20 through 23 (50%/50% application mode) have best stain resistance. Sample 20 is best of group (uses 2% and 2% owf magnesium sulfate).

TABLE XXV

| | Dyebath | | Aftertreatment | | K/A** "Dip" |
|---|---|---|---|---|---|
| No. | s.a.c. | ES* | s.a.c. | ES* | Test*** |
| 1 | 0 | 0 | — | — | F |
| 2 | 0 | 0 | 1.6 | 0 | F |
| 3 | 0 | 0 | 1.6 | 2.0 | F |
| 4 | 0 | 0 | 1.6 | 4.0 | F |
| 5 | 0.8 | 0 | 0.8 | 0 | F |
| 6 | 0.8 | 0 | 0.8 | 2.0 | F |
| 7 | 0.8 | 0 | 0.8 | 4.0 | F |
| 8 | 0.8 | 2.0 | 0.8 | 0 | S |
| 9 | 0.8 | 2.0 | 0.8 | 2.0 | P |
| 10 | 0.8 | 2.0 | 0.8 | 4.0 | S |
| 11 | 0.8 | 4.0 | 0.8 | 0 | S |
| 12 | 0.8 | 4.0 | 0.8 | 2.0 | S |
| 13 | 0.8 | 4.0 | 0.8 | 4.0 | P |
| 14 | 1.6 | 0 | — | — | F |
| 15 | 1.6 | 2.0 | — | — | F |
| 16 | 1.6 | 4.0 | — | — | S |
| 17 | 0 | 0 | 2.0 | 0 | F |
| 18 | 0 | 0 | 2.0 | 2.0 | F |
| 19 | 0 | 0 | 2.0 | 4.0 | F |
| 20 | 1.0 | 0 | 1.0 | 0 | F |
| 21 | 1.0 | 0 | 1.0 | 2.0 | F |
| 22 | 1.0 | 0 | 1.0 | 4.0 | F |
| 23 | 1.0 | 2.0 | 1.0 | 0 | P |
| 24 | 1.0 | 2.0 | 1.0 | 2.0 | P |
| 25 | 1.0 | 2.0 | 1.0 | 4.0 | P |
| 26 | 1.0 | 4.0 | 1.0 | 0 | S |
| 27 | 1.0 | 4.0 | 1.0 | 2.0 | P |
| 28 | 1.0 | 4.0 | 1.0 | 4.0 | P |
| 29 | 2.0 | 0 | — | — | F |
| 30 | 2.0 | 2.0 | — | — | F |

TABLE XXV-continued

| | | | | | |
|---|---|---|---|---|---|
| 31 | 2.0 | 4.0 | — | — | F |
| 32 | 0 | 0 | 2.8 | 0 | F |
| 33 | 0 | 0 | 2.8 | 2.0 | F |
| 34 | 0 | 0 | 2.8 | 4.0 | F |
| 35 | 1.4 | 0 | 1.4 | 0 | F |
| 36 | 1.4 | 0 | 1.4 | 2.0 | F |
| 37 | 1.4 | 0 | 1.4 | 4.0 | F |
| 38 | 1.4 | 2.0 | 1.4 | 0 | S |
| 39 | 1.4 | 2.0 | 1.4 | 2.0 | P |
| 40 | 1.4 | 2.0 | 1.4 | 4.0 | P |
| 41 | 1.4 | 4.0 | 1.4 | 0 | P |
| 42 | 1.4 | 4.0 | 1.4 | 2.0 | P |
| 43 | 1.4 | 4.0 | 1.4 | 4.0 | P |
| 44 | 2.8 | 0 | — | — | F |
| 45 | 2.8 | 2.0 | — | — | P |
| 46 | 2.8 | 4.0 | — | — | P |

*Epsom salt
**Kool Aid
***F = Fail (Noticebly Stained)
P = Pass (No Stain)
S = Slight Stain (Just Detectable)

| | | Gray Scale | |
|---|---|---|---|
| No. | 7-Hour Kool-Aid Staining* | Xenon Light-Fastness 20 AFU | Shade Change |
| 1 | 7.5 | 3.0 | — |
| 2 | — | 3.0 | 3.5 |
| 3 | — | 3.0 | 3.5 |
| 4 | — | 3.5 | 3.0 |
| 5 | — | 3.0 | 3.0 |
| 6 | — | 2.5 | 4.0 |
| 7 | — | 3.0 | 3.5 |
| 8 | 1.5 | 3.5 | 3.0 |
| 9 | 0.75 | 3.5 | 3.5 |
| 10 | 1.0 | 3.5 | 3.0 |
| 11 | 1.0 | 3.5 | 3.0 |
| 12 | 0.75 | 3.5 | 2.5 |
| 13 | 0.25 | 4.0 | 3.0 |
| 14 | — | 2.5 | 3.5 |
| 15 | — | 2.0 | 3.5 |
| 16 | 1.0 | 3.0 | 3.5 |
| 17 | — | 4.0 | 3.5 |
| 18 | — | 3.5 | 3.5 |
| 19 | — | 4.0 | 3.0 |
| 20 | — | 4.0 | 3.5 |
| 21 | — | 3.5 | 3.5 |
| 22 | — | 3.5 | 3.5 |
| 23 | 0.5 | 4.0 | 3.0 |
| 24 | 0 | 3.5 | 3.5 |
| 25 | 0.1 | 3.5 | 3.5 |
| 26 | 0.5 | 3.5 | 3.5 |
| 27 | 0 | 3.0 | 3.5 |
| 28 | 0 | 3.0 | 3.5 |
| 29 | — | 2.5 | 3.0 |
| 30 | — | 2.5 | 3.0 |
| 31 | — | 2.5 | 3.0 |
| 32 | — | 3.5 | 3.0 |
| 33 | — | 4.0 | 3.5 |
| 34 | — | 4.0 | 3.0 |
| 35 | — | 2.5 | 3.5 |
| 36 | — | 2.5 | 3.5 |
| 37 | — | 2.5 | 2.5 |
| 38 | 0.5 | 2.0 | 3.5 |
| 39 | 0.1 | 2.5 | 3.5 |
| 40 | 0 | 2.5 | 3.5 |
| 41 | 0 | 3.0 | 3.5 |
| 42 | 0 | 3.0 | 4.0 |
| 43 | 0 | 3.0 | 3.5 |
| 44 | — | 2.0 | 2.5 |
| 45 | 0.1 | 2.5 | 2.5 |
| 46 | 0.1 | 3.0 | 2.5 |

*Drop test

TABLE XXVI

| No. | Description | Original Samples Before Blot, Hours 1 |
|---|---|---|
| A | Control | 7.50 |

TABLE XXVI-continued

| | Aftertreatments | | |
|---|---|---|---|
| B | 5.0% IntratexN-1 + 4% ES* | | 0.10 |
| C | 10% Composition 3 | | 0.75 |
| D | 10% Composition 3 + 4% ES | | 0.75 |
| E | 12.5% Composition 3 | | 0.25 |
| | Two Step | | |
| | 1 | 2 | |
| F | 1.0% IntratexN-1 + 2.0% ES | 1.0% Intratex + 2.0% ES | 4.50 |
| G | 1.4% IntratexN-1 + 2.0% ES | 1.4% Intratex + 4.0% ES | 1.00 |
| H | 1.4% IntratexN-1 + 4.0% ES | 1.4% Intratex + 4.0% ES | 0.10 |
| I | 1.4% IntratexN-1 + 2.0% ES | 3.5% Comp. 3 + 4.0% ES | 1.00 |

*ES-Epsom salt

| | Original Samples Before Blot, Hours** | | | s.a.c. by analysis | Steam Cleaned Before Blot, Hours | | | |
|---|---|---|---|---|---|---|---|---|
| No. | 4 | 7 | 24 | % | 1 | 4 | 7 | 24 |
| A | 8.00 | 8.00 | 8.00 | — | — | — | — | — |
| B | 0.25 | 0.50 | 0.50 | 13.58* | 2.00 | 3.50 | 3.00 | 3.50 |
| C | 1.00 | 1.50 | 1.00 | 4.45 | 2.50 | 4.00 | 3.50 | 4.00 |
| D | 1.00 | 1.00 | 1.50 | 4.64 | 4.00 | 3.00 | 4.00 | 4.00 |
| E | 1.00 | 1.00 | 1.50 | 5.83 | 1.50 | 4.50 | 3.50 | 4.00 |
| F | 3.50 | 4.00 | 3.00 | 1.69 | 6.00 | 5.50 | 6.50 | 6.50 |
| G | 2.00 | 2.00 | 1.50 | 2.14 | 4.00 | 4.00 | 5.00 | 4.50 |
| H | 0.10 | 0.25 | 0.50 | 2.57 | 5.50 | 4.50 | 4.50 | 5.00 |
| I | 1.00 | 1.50 | 0.75 | 2.14 | 4.00 | 5.00 | 5.00 | 4.50 |

*Error in application
Note: All aftertreatments at pH = 2, 160° F. (°C.).
**Drop test 0 = best 10 worst

TABLE XXVII

| | Spot Visibility* Benzoyl Peroxide Spotting Data | | | | |
|---|---|---|---|---|---|
| No. | 0.005 | 0.01 | 0.05 | 0.1 | 1.0 |
| A | 3.50 | 6.50 | 7.50 | 9.00 | 9.00 |
| B | 3.00 | 6.50 | 7.50 | 8.00 | 8.00 |
| C | 0 | 0.50 | 1.00 | 2.00 | 2.50 |
| D | 0 | 0.25 | 1.00 | 3.00 | 3.00 |
| E | 0 | 0.10 | 0.75 | 1.50 | 1.00 |
| F | 3.00 | 6.50 | 7.50 | 8.00 | 9.00 |
| G | 4.50 | 6.50 | 7.50 | 8.00 | 8.50 |
| H | 4.00 | 6.00 | 7.00 | 8.00 | 8.50 |
| I | 0.25 | 0.75 | 1.50 | 3.00 | 3.00 |

*0 = Invisible;
10 = Bright

TABLE XXVIII

| | Gray Scale Rating | | | | | | |
|---|---|---|---|---|---|---|---|
| | Lightfastness, AFU | | | Ozone Fastness, Cycles | | No. 2 Fastness, Cycle | Shade |
| No. | 20 | 40 | 60 | 1 | 2 | 1 | Change |
| A | 4 | 3 | 2-3 | 3-4 | 2-3 | 2 | — |
| B | 3 | 2-3 | 2-3 | 4-5 | 4 | 2 | 3 |
| C | 4 | 3-4 | 3 | 4-5 | 4 | 2-3 | 3-4 |
| D | 4 | 3-4 | 3 | 4 | 3-4 | 2-3 | 3-4 |
| E | 4 | 3-4 | 3 | 4-5 | 4 | 3 | 4 |
| F | 4-5 | 4 | 4 | 4-5 | 4 | 2-3 | 2 |
| G | 4 | 3-4 | 3 | 4 | 3-4 | 2-3 | 3 |
| H | 3-4 | 3 | 3 | 4 | 3-4 | 2 | 2-3 |
| I | 4 | 3 | 3-4 | 4 | 3-4 | 3 | 3 |

TABLE XXIX

| | Dyebath % owf | | Aftertreat % owf | | K/A |
|---|---|---|---|---|---|
| No. | s.a.c. | ES* | s.a.c. | ES* | Dip Test** |
| 1 | 0 | 0 | — | — | 23 |
| 2 | 0 | 0 | 3.0 | 2.0 | 22 |
| 3 | 0 | 0 | 3.0 | 4.0 | 21 |
| 4 | 0.15 | 2.0 | 2.85 | 2.0 | 20 |
| 5 | 0.15 | 2.0 | 2.85 | 4.0 | 17 |
| 6 | 0.15 | 4.0 | 2.85 | 2.0 | 13 |
| 7 | 0.15 | 4.0 | 2.85 | 4.0 | 16 |
| 8 | 0.3 | 2.0 | 2.7 | 2.0 | 14 |
| 9 | 0.3 | 2.0 | 2.7 | 4.0 | 18 |
| 10 | 0.3 | 4.0 | 2.7 | 2.0 | 12 |
| 11 | 0.3 | 4.0 | 2.7 | 4.0 | 15 |
| 12 | 0.6 | 2.0 | 2.4 | 2.0 | 9 |
| 13 | 0.6 | 2.0 | 2.4 | 4.0 | 19 |
| 14 | 0.6 | 4.0 | 2.4 | 2.0 | 10 |
| 15 | 0.6 | 4.0 | 2.4 | 4.0 | 11 |
| 16 | 0.9 | 2.0 | 2.1 | 2.0 | 7 |
| 17 | 0.9 | 2.0 | 2.1 | 4.0 | 8 |
| 18 | 0.9 | 4.0 | 2.1 | 2.0 | 5 |
| 19 | 0.9 | 4.0 | 2.1 | 4.0 | 6 |
| 20 | 1.5 | 2.0 | 1.5 | 2.0 | 1 |
| 21 | 1.5 | 2.0 | 1.5 | 4.0 | 4 |
| 22 | 1.5 | 4.0 | 1.5 | 2.0 | 2 |
| 23 | 1.5 | 4.0 | 1.5 | 4.0 | 3 |

*ES Ep-Epsom salt
**Forced ranking (K/A = Kool-Aid)
1 = Best

| No. | 7-Hour Kool-Aid Staining* | Xenon Lightfateness 20 AFU | Shade Change | s.a.c. by analysis % |
|---|---|---|---|---|
| 1 | 7.50 | 3-4 | — | — |
| 2 | 2.50 | 4 | 4 | 3.78 |
| 3 | 3.00 | 4 | 4-5 | 3.93 |
| 4 | 1:00 | 4 | 5 | 3.38 |
| 5 | 1.50 | 3-4 | 5 | 3.48 |
| 6 | 1.50 | 4 | 4-5 | 3.38 |
| 7 | 1.50 | 4 | 4-5 | 3.60 |
| 8 | 1.00 | 4-5 | 4-5 | 3.60 |
| 9 | 1.50 | 3 | 4 | 3.60 |
| 10 | 1.00 | 3-4 | 4 | 3.38 |
| 11 | 1.50 | 3 | 4-5 | 3.29 |
| 12 | 1.00 | 4 | 4-5 | 3.24 |
| 13 | 1.00 | 3-4 | 4 | 3.00 |
| 14 | 1.50 | 4 | 4-5 | 3.15 |
| 15 | 1.50 | 3-4 | 4 | 3.22 |
| 16 | 0.75 | 3 | 4 | 3.15 |
| 17 | 0.50 | 3-4 | 4-5 | 3.00 |
| 18 | 0.75 | 4 | 4-5 | 3.03 |
| 19 | 1.00 | 3-4 | 4 | 3.10 |
| 20 | 0.10 | 3-4 | 4 | 2.72 |
| 21 | 0.50 | 3-4 | 4 | 2.86 |
| 22 | 0.10 | 3-4 | 4 | 2.82 |
| 23 | 0.75 | 3 | 4-5 | 2.91 |

*drop test

EXAMPLE 7

This example describes use of a sequestering agent in the continuous aftertreatment process of this invention. The general procedure was as in Example 2.

Experimental Summary

Substrate 1185 denier fluorocarbon treated Superba H/S in 32 ounce per square yard cut pile fabric construction and beck dyed into Argent Grey shade.

Continuously aftertreated using nominal add-on 15.9% owf Composition 2 (3.0% owf Intratex N) with no additional pH adjustment (actual pH 2.9).

Calquest ADP (Mfrs. Chem.) added to treatment bath containing Comp. 2 at levels corresponding to 0.5 and 1.0% owf.

Standard Continuous Process

Prewet/heat carpet at 195° F. (90.6° C.) and 100% w.p.u. to achieve a carpet temperature prior to treatment of 135° to 140° F. (57.2° to 60° C.).

Apply A/T liquor at 400% w.p.u. and 175° to 180° F. (79.4° to 82.2° C.) to achieve a post-A/T carpet temperature of 160 to 170° F (71.1 to 76.7° C).

After treatment, 30-second dwell time before washing (at 40:1 liquor ratio), hydroextraction and drying.

Summary of Results

The change in the dyed shade was reduced (went more to the blue side) when the sequestering agent was used.

Light induced yellowing was improved between ½ to 1 gray scale unit at 20 AFU using the sequestering agent. No further improvement was noted going from the low to the high concentration. There also appeared to be more of an improvement (or fading) of the yellowing in going from 20 to 40 AFU's when the sequestering agent was included.

Yellowing upon exposure to ozone was also minimized when the sequestering agent was included. Only a slight reduction in the yellowing upon exposure to nitrogen dioxide was observed.

There was no impact on staining, but a slight reduction in the Intratex N analyzed on carpet level was observed when the sequestering agent was used.

Conclusions

The use of sequestering agent in the Composition 2 formulation shows reduced yellowing at low lightfastness exposures and upon exposure to ozone.

TABLE XXX

EFFECT OF SEQUESTERING AGENTS ON LIGHT INDUCED YELLOWING (NOMINAL 3.0% OWF INTRATEX N ANALYSIS, STAINING PERFORMANCE, CHANGE-OF-SHADE AND COLORFASTNESS DATA

| Sample I.D. | Nominal Comp. 2 Conc., % owf | Nominal Seq. Agent Conc., % owf* | Intratex N Analyzed, % | Stain Rating (0 = best, 10 = worst) Time Before Blotting With Water, Hours 0.05 | 0.5 | 1 | 4 |
|---|---|---|---|---|---|---|---|
| 1 | N.T. | — | 0 | 7.0 | 8.5 | 8.50 | 8.5 |
| 2 | 3.0 | — | 4.22 | 0 | 0 | 0 | 0.1 |
| 3 | 3.0 | 0.5 | 3.41 | 0 | 0 | 0 | 0.1 |
| 4 | 3.0 | 1.0 | 3.66 | 0 | 0 | 0 | 0.1 |

| Sample I.D. | Stain Rating (0 = best, 10 = worst) Time Before Blotting With Water, Hours 8 | 24 | Shade Change | Grey Scale Rating: Light-fastness, AFU 20 | 60 | Ozone-fastness cy 1 | 2 | $NO_2$*** Fastness, cy 1 |
|---|---|---|---|---|---|---|---|---|
| 1 | 8.5 | 8.5 | — | 3.5 | 2.5 | 3.0 | 2.5 | 2.5 |
| 2 | 0.1 | 0.1 | M(B) | 2.5 | 3.0 | 3.0 | 2.5 | 1.0 |
| 3 | 0.1 | 0.1 | M-Y(B) | 3.5 | 4.0 | 3.0 | 3.0 | 1.5 |
| 4 | 0.1 | 0.1 | M-Y(B) | 3.5 | 3.5 | 3.0 | 3.0 | 1.5 |

*Calquest ADP (Manufacturers Chemical)
**N.T. = Not treated
***High R.H. Nitrogen Dioxide. AAT TM-164.

Other sequestering agents would also be useful, for example, the polyphosphates, such as Calgon which is sodium hexametaphosphate, aminocarboxylic acids, such as EDTA or ethylenediaminetetraacetic acid, the amino alcohols, and the hydroxycarboxylic acids, including citric acid.

TABLE XXXI

ADDITION OF SEQUESTERING AGENTS TO INHIBIT LIGHT INDUCED YELLOWING (1185 Fluorocarbon Treated Superba Substrate, Nominal 15.9% owf Composition 2 - 3.0% Intratex N)

Analysis and Colorfastness Data

| Sample I.D. | Additives | A/T pH | s.a.c. Analyzed |
|---|---|---|---|
| 1 | Not Treated | — | 0 |
| 2 | No Additive (Comp. 2 only) | 3.0 | 2.46 |
| 3 | 0.50% owf Calquest ADP | 3.3 | 2.95 |
| 4 | 0.10% owf Sequestrene 30A | 3.2 | 2.75 |
| 5 | 0.25% owf Sequestrene 30A | 3.7 | 3.02 |
| 6 | 0.50% owf Sequestrene 30A | 3.3** | 2.54 |
| 7 | 0.10% owf SHMP* | 3.0 | 2.80 |
| 8 | 0.25% owf SHMP* | 3.3 | 2.95 |
| 9 | 0.50% owf SHMP* | 3.6 | 3.09 |

| Sample I.D. | Grey Scale Rating: Lightfastness, AFU 20 | 40 | Ozonefastness, cy 1 | 2 | $NO_2$* Fastness, cy 1 |
|---|---|---|---|---|---|
| 1 | 5.0 | 4.5 | 3.0 | 2.5 | 2.5 |
| 2 | 3.0 | 3.5 | 3.5 | 3.0 | 1.5 |
| 3 | 3.0 | 3.5 | 4.0 | 3.0 | 2.0 |
| 4 | 4.0 | 4.0 | 3.5 | 3.0 | 2.0 |
| 5 | 4.0 | 3.5 | 4.0 | 3.0 | 2.0 |
| 6 | 4.0 | 3.5 | 3.5 | 3.0 | 2.0 |
| 7 | 4.0 | 3.5 | 3.5 | 3.0 | 2.0 |
| 8 | 3.5 | 3.5 | 3.0 | 2.5 | 2.0 |
| 9 | 3.5 | 3.5 | 3.5 | 3.0 | 2.0 |

*Sodium Hexametaphosphate.
**Sulfamic Acid required to lower pH after the additive added to A/T liquor.

TABLE XXXII

ADDITION OF SEQUESTERING AGENTS TO INHIBIT LIGHT INDUCED YELLOWING STAINING DATA

| Sample I.D. | A/T pH | Stain Rating (0 = best 10 worst) Time Before Blotting With Water, Hours 1 | 4 | 8 | 24 | Shade Change* |
|---|---|---|---|---|---|---|
| 1 | — | 9.5 | 9.5 | 9.5 | 9.5 | — |
| 2 | 3.0 | 0.25 | 0.25 | 0.75 | 1.25 | M-N |
| 3 | 3.3 | 0.75 | 0.73 | 0.75 | 0.75 | M-N |
| 4 | 3.2 | 0.25 | 0.75 | 0.75 | 0.75 | M-N |
| 5 | 3.7 | 0.5 | 1.0 | 1.25 | 1.25 | N |
| 6 | 3.3 | 0.5 | 0.5 | 1.0 | 1.5 | M-N |
| 7 | 3.0 | 0.25 | 0.75 | 0.75 | 0.75 | N |
| 8 | 3.3 | 0.5 | 1.0 | 1.0 | 1.0 | N |
| 9 | 3.6 | 0.25 | 0.5 | 1.0 | 1.0 | N |

*M = moderate N = none

EXAMPLE 8

Method for Exhausting Ammonium Thiocyanate Onto Dyed Nylon

Fiber to Improve its Resistance to Oxidizing Agents

Description of the Embodiment

Dyed carpet fiber, especially that made from nylon, whether or not it is treated with a sulfonated aromatic condensate or other treatments, is susceptible to significant color fading due to exposure to ozone, benzoyl peroxide and products containing chlorine. The problem was lessened to some extent when the dye industry changed over to acid dyes from disperse dyes. Acid dyes were less able to migrate and be destroyed by ozone because they were electronically bound to the nylon. However, the use of acid dyes did not eliminate these color fastness problems.

There are many antioxidants and antiozonants available on the market. These products are usually aromatic and contain amine or sulfur functonalities. These products have several disadvantages: aromatics usually yellow the fiber upon further heat treatment, and the amines and sulfur functionalities cause a reduction in nylon lightfastness. Also, these chemistries probably act as sacrificial agents and it has been difficult to apply enough onto the fiber to have long term benefit.

The thiocyanates, such as ammonium thiocyanate, are antiozonants that are well known. The cation of the thiocyanate may be ammonium, sodium, potassium, zinc, copper, ferrous, ferric, methyl or phenyl. They had the additional advantage over the other antioxidants in that they do not reduce lightfastness. However, it has not been economically possible to apply enough of the thiocyanate during dyeing to have long term effectiveness as it is also a sacrificial agent. (Ammonium thiocyanate also appears to aglomerate the dye molecules which also improves ozone fastness.)

In order to apply ammonium thiocyanate economically, it is necessary to devise a process in which it essentially exhausts onto the fiber. At pH=7 and 212° F. (100° C.) (normal dyeing conditions), the ammonium thiocyanate will not exhaust onto the fiber as it is water soluble and not very substantive to nylon. However, it has been found that at acidic pH's, especially at about pH 1.5 to pH 5, the ammonium thiocyanate will exhaust onto the nylon.

Comparison of Various Thiocyanates

A comparison was made of the performance of several organic and inorganic thiocyanate compounds which had been aftertreated onto fluorocarbon treated nylon carpet fiber knitted into sleeves at pH=2, 140° F. (60° C.), 20:1 liquor:goods and 20 minutes. No dyes were added. The following thiocyanates were evaluated:

| Added as Received, % | Thiocyanate | Activity, % |
|---|---|---|
| 0.30 | $NH_4SCN$ | 100 |
| 0.32 | NaSCN | 100 |
| 0.38 | KSCN | 100 |
| 0.48 | CuSCN | 100 |
| 2.57 | $CH_2(SCN)_2$ | 10 |
| 3.13 | $Ph(S)N{=}CCH_2SCN$ | 30 |

The amounts added introduced an equivalent quantity of thiocyanate concentration onto the fiber.

The ammonium, sodium and potassium thiocyanates were all equally superior to untreated nylon in resistance to ozone, benzoyl peroxide and chlorine bleach fastness. The other 15 thiocyanates were slightly more resistant to these color fade tests than the untreated nylon. The xenon lightfastness of all the samples were similar to untreated nylon except CuSCN which was more resistant and the phenyl-based thiocyanate which was much worse.

Effect of pH

Using the same conditions as above but varying pH and using only $NH_4SCN$, the percent exhaustion of $NH_4SCN$ onto fiber was measured at the pH levels shown.

| pH | Exhaustion, % |
|---|---|
| 1 | 60 |
| 2 | 60 |
| 3 | 40 |
| 4 | 10 |
| 5 | 10 |
| 6 | 8 |
| 7 | 9 |

Effect of Temperature

In another test at the same conditions pH 2 temperature was varied to achieve the following exhaustion levels.

| Temperature, °F. | Temperature, (°C.) | Exhaustion, % |
|---|---|---|
| 75 | 23.9 | 70 |
| 100 | 37.8 | 66 |
| 120 | 48.9 | 63 |
| 140 | 60.0 | 60 |
| 180 | 82.2 | 75 |
| 200 | 93.3 | 98 |

Thus by raising the temperature, it is expected that more complete exhaustion can be achieved at higher pH levels.

In a separate test at the same conditions but varying time, it was found that time between 5 and 50 minutes had little effect on exhaustion levels. On the other hand, increasing the concentration of $NH_4SCN$ lowers the level of exhaustion. It was also found that putting increasing amounts of $NH_4SCN$ on the fiber has only a very small effect on ozonefastness over 2,000 ppm, a little effect over 1,000 ppm, but a large effect between 0 and 1,000 ppm. It was noted that the $\Delta E$ in the standard 5-cycle AATCC ozonefastness changed from 6 at 500 ppm to only 2 at 1,000 ppm.

DISCUSSION

The above examples are but a few of the many embodiments and variations of this invention. One skilled in the art would be able to select the proper conditions and amounts of chemical compounds for other embodiments of this invention to achieve the results desired after learning the teachings of this invention, including the Examples and the broader teachings of the Summary of the Invention above. The broader teachings are based on economic, technical and practical limitations to practice the invention. However, it may sometimes be useful to operate outside these economic or practical limitations for special reasons.

The following discussion will describe some of the practical, economical and/or technical limitations of the parameters of the embodiments of this invention.

First, regarding the operating conditions of the continuous aftertreatment method, including two-step application methods, of this invention, the following table lists reasons for the limitations given.

| Limitation Variation | Reason |
|---|---|
| preheat water temp. below 140° F. (60° C.) and carpet temp. below 130° F. (54.4° C.) | less uniform application during the following treatment and less effective or economic to heat carpet |
| preheat water temp. above | atmospheric process, water |

-continued

| Limitation Variation | Reason |
|---|---|
| 212° F. (100° C.) and carpet above 210° F. (°C.) | cannot be heated above the boiling point |
| less than 75% w.p.u. preheat step | less uniform, poor penetration |
| extracting to less than 30% w.p.u. | less uniform, poor penetration |
| extracting to above 190% w.p.u. | diluteds following application liquor, less effective |
| application pH below 1.5 | corrosive |
| application pH above 5.5 | less effective, due to comounds of aqueous soln. penetrating too deep into fiber, at very high pH no exhaustion of compositions |
| application less than 200% w.p.u. | less effective |
| application over 650% w.p.u. | carpet fabric cannot hold much more aqueous solution |
| conc. of s.a.c. less than 0.25 g/l | less effective |
| conc. of s.a.c. over 40 g/l | uneconomical |
| application soln. temp. under 140° F. (60° C.) and carpet temp. under 130° F. (54.4° C.) | less effective |
| application soln. temp. over 212° F. (100° C.) and carpet temp. over 210° F. (99° C.) | atmospheric process, water cannot be heated above the boil |
| less than 0.05% owf $MgSO_4$ | less effective |
| more than 0.8% owf $MgSO_4$ | adverse color fastness results |
| less than 0.03% owf $NH_4SCN$ | less effective |
| more than 1% owf $NH_4SCN$ | uneconomical |
| less than 0.15% owf s.a.c. | less effective |
| more than 7.5% owf s.a.c. | uneconomical |
| more than 6 or 3 parts to parts of s.a.c. of the respective dispersing agents | uneconomical, possible adverse chemical activity |

The following table lists reasons for limitation parameters for the two-step, batch-batch method of this invention.

| Limitation Variation | Reason |
|---|---|
| second step pH below 1.5 | corrosive |
| second step pH above 5.5 | less effective, due to compounds of aqueous soln. penetrating too deep into fiber, at very high pH no exhaustion of compositions |
| second step temp. below 110° F. (°C.) | uneconomical, takes too long |
| second step temp. above 195° F. (°C.) | less effective, due to compounds of aqueous soln. penetrating too deep into fiber |
| first & second step liquor: fabric ratio below 10 | less uniform, poor wetting and penetration |
| first & second step liquor: fabric ratio above 100 | uneconomical |
| first step temp. below 158° F. (70° C.) | uneconomical, nonuniform application, takes too long |
| first step temp. above 212° F. (100° C.) | atmospheric process, water cannot be heated above the boil |
| first step treating time less than 15 minutes | blotches and streaks, nonuniform |
| first step treating time over 90 minutes | uneconomical |
| second step treating time under 5 minutes | nonuniform application |
| less than 0.05% owf fluorocarbon on pretreated fabric | does not provide anti-soiling effect |
| over 0.4% owf fluorocarbon on pretreated fabric | uneconomical |
| below 0.25% owf $MgSO_4$ | ineffective |
| over 4% owf $MgSO_4$ | poor lightfastness, uneconomical, poor dyeing, shade changes |
| below 0.03% owf $NH_4SCN$ | ineffective |
| above 1% owf $NH_4SCN$ | uneconomical |
| below 0.15% owf s.a.c. | ineffective |
| above 7.5% owf s.a.c. | fabric discolors, fabric stiff, poor dye yield, yellowing |

The benefits of the best mode of this invention using Composition 1 in a two-step, continuous-continuous process as described above in Example 1 are given below. Most or some of the individual benefits given are also achieved by the other embodiments of this invention.

improved stain resistance, particularly for carpet fabric of high ICP nylon fiber, substantially eliminates light induced yellowing of sulfonated aromatic condensate treated fiber, reduces $NO_2$ yellowing of sulfonated aromatic condensate treated fiber, improves resistance of dye on sulfonated aromatic condensate treated fiber to fading from ozone and oxidation by benzoyl peroxide, improves penetration of sulfonated aromatic condensate and treatment chemicals into the carpet fabric, including the base or backing, does not significantly impact the soil resistance of the fluorocarbon treatment on the fiber of the carpet fabric, improves durability of the sulfonated aromatic condensate and treatment chemicals to steam cleaning with high pH detergents.

We claim:

1. The method of improving exhaustion of a water soluble thiocyanate onto polyamide fiber comprising contacting said fiber with an effective amount of said thiocyanate at a pH between about 1 and 5 wherein said fiber has improved resistance to fading of dye due to strong oxidizing agents such as benzoyl perioxide or ozone, said dye being present in or on said fiber.

2. The method of claim 1 wherein said thiocyanate is ammonium, sodium, potassium, or zinc.

3. The method of claim 2 wherein the pH is between about 1 and 4.

4. The method of claim 3 wherein between about 0.1 and about 6% on the weight of the fiber of said thiocyanate is present in or on said fiber after dyeing.

5. The method of claim 4 wherein between about 0.1 and about 12% on the weight of the fiber of said thiocyanate is present during said contacting of said fiber and at least 50% of said thiocyanate present during said contacting is exhausted onto or into said fiber.

6. The method of claim 3 wherein said thiocyanate is ammonium thiocyanate.

7. The method of claim 3 wherein said thiocyanate is contacted with said fiber in a dyebath.

8. The method of claim 3 wherein said thiocyanate is contacted with said fiber after dyeing of said fiber.

9. The method of claim 3 wherein said fiber comprises an effective amount of a fluorocarbon to improve soiling of said fiber, and a sulfonated aromatic condensate is present either on the fiber or co-applied with the thiocyanate.

10. The method of claim 9 wherein said fluorocarbon contains perfluoroalky radical and said sulfonated aromatic condensate is formed by condensation of formaldehyde with one or more phenols.

11. The method of claim 10 wherein sad fluorocarbon is a mixture of oligomers formed by two reactions, first, the reaction of pyromellitic dianhydride with a fluorinated alcohol, second, said reaction product further reacted with epichlorohydrin, and said condensate is formaldehyde condensed with an alkali salt of paraphenol sulfonic acid and with 4,4'-diphenolsulfone.

12. The method of claim 10 wherein between about 0.1 and 12% thiocyanate on the weight of the fiber, and between about 0.05 and 0.4% fluorocarbon on the weight of the fiber are present during said contacting.

13. The method of claim 1 wherein an effective amount of a sulfonated aromatic condensate is also used to contact the polyamide fiber so that said fiber has improved resistance to staining at low concentrations of said condensate.

14. The method of claim 13 wherein the amount of sulfonated aromatic condensate used is in water at between about 0.25 and 40 grams of solids of said condensate per liter of aqueous solution.

15. The method of claim 13 wherein the sulfonated aromatic condesate is formed by condensation of formaldehyde with one or more dihydroxy aromatic dipherol sulfones.

16. The method of claim 13 wherein the condensate is formaldehyde condensed with an alkali metal salt of parpa-phenol sulfonic acid and with 4,4'-diphenolsulfone.

17. The method to improve resistance to ozidation of stain resistant, dyed nylon carpet fiber comprising treating said fiber with an effective amount of a thiocyanate.

18. The method of claim 17 wherein said thiocyanate is ammonium, sodium, potassium or zinc.

19. The method of claim 17 wherein said fiber is treated with said thiocyanate at a pH of between about 1 and 5.

20. The method of claim 17 wherein between about 0.1% and about 6% on the weight of the fiber of said thiocyanagte is present in or on the fiber after said treating.

21. The method of claim 17 wherein said thiocyanate is ammonium thiocyanate.

22. The method of claim 17 wherein said fiber is treated with the thiocyanate in a dyebath.

23. The method of claim 17 wherein said fiber is treated with the thiocyanate after dyeing.

24. The method of claim 17 wherein said fiber is stain resistant due to treatment with a sulfonated aromatic condensate.

* * * * *

UNITED STATES PATENT AND TRADEMARK OFFICE

CERTIFICATE OF CORRECTION

PATENT NO. : 5,152,803

DATED : October 6, 1992

INVENTOR(S) : Dale Alan Hangey and Roger Neil Spitz

It is certified that error appears in the above-identified patent and that said Letters Patent is hereby corrected as shown below:

Col. 40 line 44: "perioxide" should read --peroxide--

Col. 41 line 5: "sad" should read --said--

Col. 42 lines 1 and 2: "dipherol" should read --diphenol--

Col. 42 line 7: "ozidation" should read --oxidation--

Col. 42 line 17: "thiocyanagte" should read --thiocyanate--

Signed and Sealed this

Twenty-first Day of September, 1993

Bruce Lehman

*Attest:*

BRUCE LEHMAN

*Attesting Officer*

*Commissioner of Patents and Trademarks*